US012134959B2

(12) United States Patent
Poizat

(10) Patent No.: US 12,134,959 B2
(45) Date of Patent: Nov. 5, 2024

(54) MULTI-TRIP WELLBORE COMPLETION SYSTEM WITH A SERVICE STRING

(71) Applicant: Schlumberger Technology Corporation, Sugar Land, TX (US)

(72) Inventor: Jeremie Poizat, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 79 days.

(21) Appl. No.: 17/995,611

(22) PCT Filed: Apr. 14, 2021

(86) PCT No.: PCT/US2021/027205
§ 371 (c)(1),
(2) Date: Oct. 6, 2022

(87) PCT Pub. No.: WO2021/211664
PCT Pub. Date: Oct. 21, 2021

(65) Prior Publication Data

US 2023/0228175 A1 Jul. 20, 2023

Related U.S. Application Data

(60) Provisional application No. 63/010,616, filed on Apr. 15, 2020.

(51) Int. Cl.
*E21B 43/14* (2006.01)
*E21B 17/18* (2006.01)
(Continued)

(52) U.S. Cl.
CPC ..... *E21B 43/14* (2013.01); *E21B 17/18* (2013.01); *E21B 33/12* (2013.01); *E21B 43/04* (2013.01);
(Continued)

(58) Field of Classification Search
CPC ..... E21B 43/14; E21B 43/10; E21B 43/04; E21B 43/12; E21B 43/00; E21B 43/08;
(Continued)

(56) References Cited

U.S. PATENT DOCUMENTS 5,921,318 A 7/1999 Ross
6,446,729 B1 9/2002 Bixenman et al.
(Continued)

FOREIGN PATENT DOCUMENTS

EP 2184436 A2 5/2010
EP 2631423 A1 8/2013
(Continued)

OTHER PUBLICATIONS

International Search Report and Written Opinion issued in PCT Application PCT/US2021/026104 dated Aug. 2, 2021 (12 pages).
(Continued)

*Primary Examiner* — George S Gray
(74) *Attorney, Agent, or Firm* — Jeffrey D. Frantz

(57) ABSTRACT

A system includes an outer completion string, an inner service string configured to connect within the outer completion string, and an upper completion. The outer completion string includes at least one isolation packer, a sand control assembly and a gravel pack extension disposed uphole of a washdown shoe in a bottom-most well zone. In a top well zone, the outer completion string includes a latch profile, a female inductive coupler, a gravel pack packer, and a sand control assembly and a gravel pack extension disposed downhole of the gravel pack packer. The inner service string includes, among other components, an inner concentric string that is concentrically arranged within a workstring creating an inner-annulus between the workstring and the inner concentric string. The upper completion includes a
(Continued)

male inductive coupler that is configured to connect with the female inductive coupler of the outer completion string.

12 Claims, 22 Drawing Sheets

(51) Int. Cl.

| | |
|---|---|
| ***E21B 33/12*** | (2006.01) |
| ***E21B 34/06*** | (2006.01) |
| ***E21B 43/04*** | (2006.01) |
| ***E21B 43/08*** | (2006.01) |
| ***E21B 43/12*** | (2006.01) |

(52) U.S. Cl.
CPC ..... *E21B 43/08* (2013.01); *E21B 43/12* (2013.01); *E21B 34/063* (2013.01); *E21B 34/066* (2013.01); *E21B 2200/06* (2020.05)

(58) Field of Classification Search
CPC ..... E21B 33/13; E21B 33/12; E21B 34/06; E21B 34/08; E21B 34/10; E21B 34/12; E21B 34/14; E21B 34/063; E21B 34/066; E21B 23/06; E21B 23/04; E21B 41/00; E21B 2200/06; E21B 17/18
See application file for complete search history.

(56) References Cited

U.S. PATENT DOCUMENTS

| | | | | |
|---|---|---|---|---|
| 6,681,854 | B2 | 1/2004 | Danos | |
| 6,684,952 | B2 | 2/2004 | Brockman et al. | |
| 7,165,618 | B2 | 1/2007 | Brockman et al. | |
| 7,562,709 | B2 | 7/2009 | Saebi et al. | |
| 7,918,276 | B2 | 4/2011 | Guignard et al. | |
| 8,127,845 | B2 | 3/2012 | Assal | |
| 8,496,055 | B2 | 7/2013 | Mootoo et al. | |
| 8,511,380 | B2 | 8/2013 | Guignard et al. | |
| 8,988,178 | B2 | 3/2015 | Deville et al. | |
| 9,000,873 | B2 | 4/2015 | Deville et al. | |
| 9,638,012 | B2 | 5/2017 | Yeh et al. | |
| 2002/0117301 | A1 | 8/2002 | Womble | |
| 2002/0189809 | A1 | 12/2002 | Nguyen et al. | |
| 2002/0195253 | A1 | 12/2002 | Hill, Jr. et al. | |
| 2007/0235185 | A1 | 10/2007 | Patel | |
| 2009/0025923 | A1 | 1/2009 | Patel et al. | |
| 2010/0175894 | A1* | 7/2010 | Debard | E21B 34/10 166/382 |
| 2013/0000899 | A1 | 1/2013 | Broussard | |
| 2014/0034336 | A1 | 2/2014 | Jasek | |
| 2014/0083766 | A1* | 3/2014 | Tips | E21B 44/00 175/24 |
| 2014/0251609 | A1 | 9/2014 | Broussard | |
| 2015/0047837 | A1 | 2/2015 | Turner et al. | |
| 2015/0053408 | A1 | 2/2015 | Purkis et al. | |
| 2015/0075780 | A1 | 3/2015 | Richards | |
| 2015/0198016 | A1 | 7/2015 | Langlais | |
| 2015/0315895 | A1 | 11/2015 | Patel et al. | |
| 2017/0138158 | A1 | 5/2017 | Bourgneuf | |
| 2017/0241214 | A1 | 8/2017 | Billingham | |
| 2017/0342810 | A1 | 11/2017 | Richards | |
| 2018/0163486 | A1* | 6/2018 | Davies | E21B 43/10 |
| 2020/0141211 | A1 | 5/2020 | Franklin | |
| 2021/0123327 | A1 | 4/2021 | Langlais et al. | |
| 2021/0363862 | A1 | 11/2021 | Langlais | |

FOREIGN PATENT DOCUMENTS

| | | | |
|---|---|---|---|
| EP | 2899367 | A2 | 7/2015 |
| WO | 2007092082 | A2 | 8/2007 |
| WO | 2008036553 | A2 | 3/2008 |
| WO | 2009015109 | A1 | 1/2009 |
| WO | 2009061542 | A1 | 5/2009 |
| WO | 2011011306 | A1 | 1/2011 |
| WO | 2017155546 | A1 | 9/2017 |
| WO | 2018187854 | A1 | 10/2018 |
| WO | 2019246501 | A1 | 12/2019 |
| WO | 2020172466 | A1 | 8/2020 |
| WO | 2020206211 | A1 | 10/2020 |
| WO | 2021207304 | A1 | 10/2021 |

OTHER PUBLICATIONS

International Search Report and Written Opinion issued in PCT Application PCT/US2021/027205 dated Jul. 14, 2021 (12 pages).
Combined Search and Examination Report Under Sections 17 and 18(3) issued United Kingdom Patent Application No. GB2216735.8 dated May 13, 2022, 7 pages.
Office Action issued in Azerbaijan Patent Application No. a20210116 dated May 10, 2022, 5 pages with English translation.

* cited by examiner

Detail D

Detail C

Detail B

Detail A

| Position | System Valves | | | | | |
|---|---|---|---|---|---|---|
| | Return Valve | Reverse Valves | Treat Valves | Isolation Valves | Port Closure Sleeves | Manara Valves |
| RIH | Open | Closed | Open | Open | Open | Closed |
| Wash Down | Closed | Closed | Closed | Open | Open | Closed |
| Set Top Packer | Closed | Closed | Closed | Open | Open | Closed |
| Displace OH | Open | Closed | UV LV | UV LV | Open | UV LV |
| Set Packers | Open | Closed | Closed | Open | Open | Closed |
| Treat Lower | Open | Closed | UV LV | UV LV | Open | UV LV |
| Reverse Lower | Open | UV LV | Closed | UV LV | Open | Closed |
| Treat Upper | Open | Closed | UV LV | Closed | Open | UV LV |
| Reverse Upper | Open | UV LV | Closed | Closed | Open | Closed |
| POOH | | | | | Closed | Closed |
| Produce | | | | | Closed | Open |

Closed
Open

FIG. 3L

| Position | System Valves | | | | |
|---|---|---|---|---|---|
| | Treat Valve | Reverse Valve | Shoe | Port Closure Sleeves | Manara Valves |
| RIH/ Washdown | Closed | Closed | Open | Closed | Closed |
| Set Top Packer | Closed | Closed | Closed | Closed | Closed |
| Set OH Packer Lower | Open | Closed | Closed | Closed | UV Closed, LV Open |
| Treat Lower | Open | Closed | Closed | UV Closed, LV Open | UV Closed, LV Open |
| Reverse / Clean Lower | Closed | Open | Closed | Closed | Closed |
| Complete Reverse | Closed | Open | Closed | Closed | Closed |
| Set OH Packer Upper | Open | Closed | Closed | Closed | UV Open, LV Closed |
| Treat Upper | Open | Closed | Closed | UV Open, LV Closed | UV Open, LV Closed |
| Reverse / Clean Upper | Closed | Open | Closed | Closed | Closed |
| Complete Reverse | Closed | Open | Closed | Closed | Closed |
| POOH | | | | Closed | Closed |
| Produce | | | | Closed | Open |

Closed
Open

FIG. 6M

| Position | System Valves | | | |
|---|---|---|---|---|
| | Upper Ports | Lower Ports | FCV | FIV |
| RIH | Closed | Closed | | |
| Drop Ball Set Packers | Closed | Closed | | |
| Treat Lower | Closed | Open | | |
| Reverse Lower | Closed | Closed | | |
| Treat Upper | Open | Closed | | |
| Reverse Upper | Closed | Closed | | |
| POOH | Closed | Closed | | |
| Run Intermediate | Closed | Closed | Closed | Closed |
| Produce | Closed | Closed | Open | Open |

MULTI-TRIP WELLBORE COMPLETION SYSTEM WITH A SERVICE STRING

CROSS-REFERENCE TO RELATED APPLICATIONS

The present document is a National Stage of International Application No. PCT/US2021/027205, filed Apr. 14, 2021, which is based on and claims priority to U.S. Provisional Application Ser. No. 63/010,616, filed Apr. 15, 2020, which are incorporated herein by reference in their entirety.

BACKGROUND

Subterranean hydrocarbon services are often necessary to produce hydrocarbons from a subterranean formation. Such services can include, without limitation, perforating operations, completion operations, gravel pack operations, frac pack operations, clean-up operations, flow-back operations, treatment operations, testing operations, production operations, injection operations, and monitor and control operations. Each service is typically performed by running specially designed, service-specific equipment into and out of the wellbore. This is problematic because each trip into and out of the wellbore increases operational risks, rig time, and personnel hours.

While the repetitive steps of running and removing multiple work strings into the well is extremely time consuming and costly, it is even more time consuming and costly to complete boreholes with multiple producing zones within the same formation because each zone is typically completed and produced one at a time. It is highly desirable to complete all zones in a minimum number of trips. There is a need, therefore, for new systems and methods that allow the deployment of the entire completion hardware for multiple zones in a minimum number of trips.

SUMMARY

In a system deployed in a wellbore extending through a plurality of well zones, according to one or more embodiments of the present disclosure, the system includes: an outer completion string including: at least one isolation packer positioned between well zones of the plurality of well zones, the plurality of well zones including: a bottom-most well zone; and a top well zone; a washdown shoe disposed in the bottom-most well zone; a first sand control assembly and a first gravel pack extension, each disposed uphole of the washdown shoe in the bottom-most well zone, wherein the top well zone includes a latch profile; a female inductive coupler; and a gravel pack packer, wherein the top well zone further includes a second sand control assembly; and a second gravel pack extension, each of the second sand control assembly and the second gravel pack extension being disposed downhole of the gravel pack packer; an inner service string configured to connect within the outer completion string, the inner service string including: a workstring; a set and release section that connects to the latch profile of the outer completion string; a power module; a return valve assembly; a circulating assembly for each well zone; an inner concentric string that is concentrically arranged within the workstring creating an inner-annulus between the workstring and the inner concentric string, wherein the inner-annulus is continuous from the circulating assembly for the bottom-most well zone to the return valve assembly; and a port closure sleeve collet; and an upper completion including a male inductive coupler that is configured to connect with the female inductive coupler of the outer completion string.

In a system deployed in a wellbore extending through a plurality of well zones, according to one or more embodiments of the present disclosure, the system includes: an outer completion string including: at least one isolation packer positioned between well zones of the plurality of well zones, the plurality of well zones including: a bottom-most well zone; and a top well zone; a washdown shoe disposed in the bottom-most well zone; a first sand control assembly and a first treatment extension, each disposed uphole of the washdown shoe in the bottom-most well zone, wherein the top well zone includes a latch profile; a female inductive coupler; and a treatment packer, wherein the top well zone further includes a second sand control assembly; and a second treatment extension, each of the second sand control assembly and the second treatment extension being disposed downhole of the treatment packer; an inner service string configured to move within the outer completion string, the inner service string including: a workstring; a set and release section that connects to the latch profile of the outer completion string; a power module; a single circulating assembly; a port closure sleeve collet; and a flow deactivated washdown shoe; and an upper completion including a male inductive coupler that is configured to connect with the female inductive coupler of the outer completion string.

In a system deployed in a wellbore extending through a plurality of well zones, according to one or more embodiments of the present disclosure, the system includes: an outer completion string including: at least one isolation packer positioned between well zones of the plurality of well zones, the plurality of well zones including: a bottom-most well zone; and a top well zone; a washdown shoe disposed in the bottom-most well zone; a first zonal contact valve disposed uphole of the washdown shoe in the bottom-most well zone; wherein the top well zone includes a latch profile; and a treatment packer; wherein the top well zone further includes a second zonal contact valve that is disposed downhole of the treatment packer; an inner service string configured to move within the outer completion string, the inner service string including: a workstring; a set and release section that connects to the latch profile of the other completion string; a hydraulic hold down module; a plurality of cups; and at least one zonal contact valve shifter configured to manipulate the first and second zonal contact valves; an intermediate completion string including: an intermediate packer; a female inductive coupler; a formation isolation valve with a trip saver; a flow control valve for each well zone of the plurality of well zones; and a zonal contact valve shifter, wherein the female inductive coupler, the formation isolation valve with the trip saver, each flow control valve, and the zonal contact valve shifter are each downhole of the production packer on the intermediate completion string; and an upper completion including a male inductive coupler that is configured to connect with the female inductive coupler of the intermediate completion string.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and:

FIG. 3L shows a truth table of the system valves of the inner service string arranged inside the outer completion string in view of the method shown in FIGS. 3A-3K according to one or more embodiments of the present disclosure;

FIG. 6M shows a truth table of the system valves of the inner service string movably arranged inside the outer completion string in view of the method shown in FIGS. 6A-6L according to one or more embodiments of the present disclosure;

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

In the specification and appended claims: the terms "up" and "down," "upper" and "lower," "upwardly" and "downwardly," "upstream" and "downstream," "uphole" and "downhole," "above" and "below," "top," and "bottom," and other like terms indicating relative positions above or below a given point or element are used in this description to more clearly describe some embodiments of the disclosure.

The present disclosure generally relates to systems and methods for completing a wellbore. More specifically, the present disclosure relates to a system including at least an outer completion string, an inner service string, an upper completion, and a method for completing a wellbore requiring stimulation and/or sand control with downhole flow control in a multizone environment. Even more specifically, one or more embodiments of the present disclosure relates to a system and method for treating one or multiple subterranean formations and installing all the lower completion hardware (safety valve, gauge mandrels etc.) in a single first trip. The completion string embodies a well treatment system, which provides a means for circulating or squeeze type of treatment and clean up via reversing out excess slurry (proppant) by reverse flow. One or more embodiments of the present disclosure allow the incorporation of downhole flow control for each interval. In one or more embodiments of the present disclosure, an upper completion may be installed in a subsequent trip. Moreover, some embodiments also include another trip for running an intermediate completion string.

The completion design according to one or more embodiments of the present disclosure is a two trip gravel pack/frac pack completion with integrated electrical flow control valves. The lower completion string is lowered in the hole and set, and all sand control treatment operations are performed from that position with a service string with or without movement for all well zones from setting packers, until the service string is POOH. Flow control functionality is either integrated in the sand control system or lowered inside of it. Subsequently, an upper completion string is lowered in the wellbore with a male inductive coupler. Because the service string is pulled out of hole before production, a larger production ID of the system may be realized. Further, the completion design according to one or more embodiments of the present disclosure provides for a lower completion that is relatively simple in complexity insofar as the complexity of the system is captured in the service string.

Figure 1:
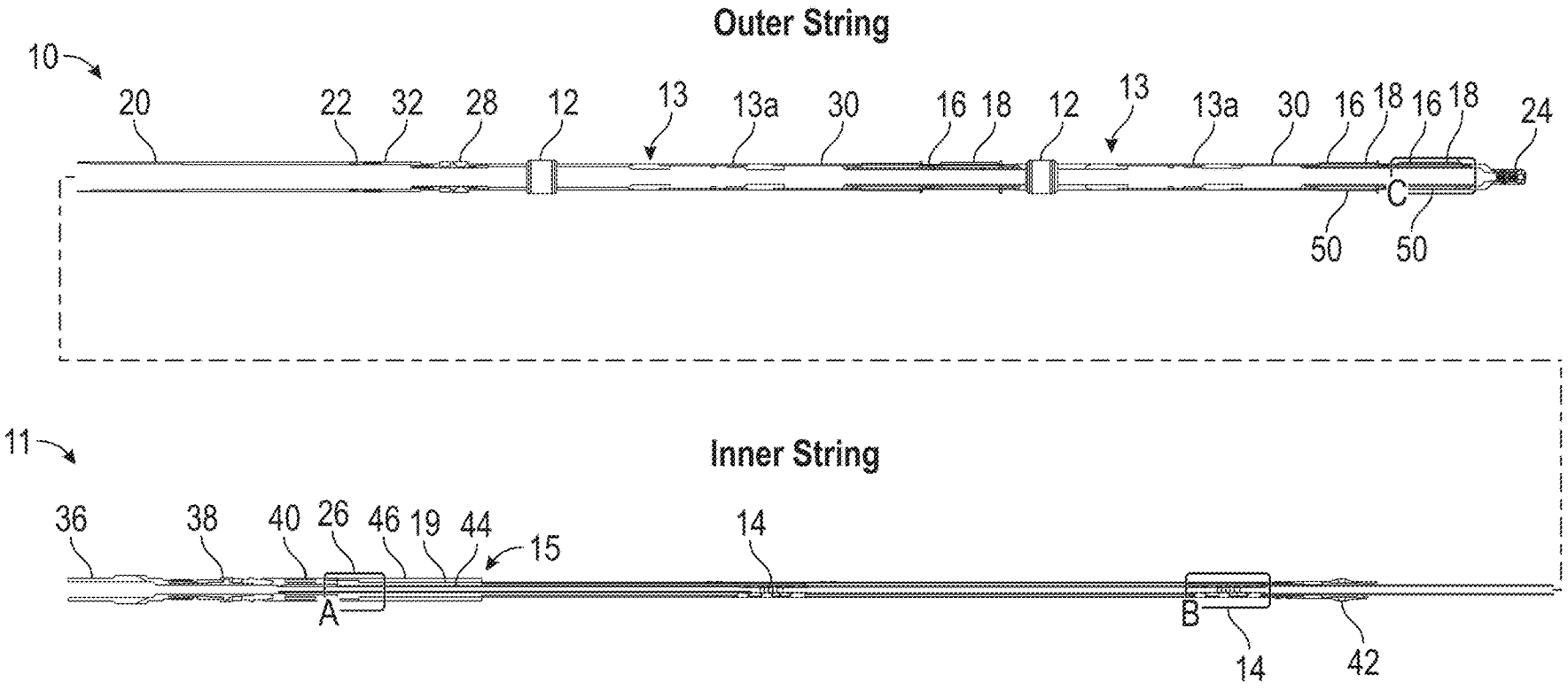
FIG. 1 shows a system including an outer completion string and an inner service string according to one or more embodiments of the present disclosure.

Referring now to FIGS. 1-3L, a completion design according to one or more embodiments of the present disclosure is shown. Specifically, FIG. 1 shows a layout of the completion design with its main components for a two zone completion. The upper completion detail hardware is not specified here. The connection between the upper and lower completion string is enabled via the Schlumberger's Inductive Coupler. Operationally, the completion design according to one or more embodiments of the present disclosure is similar to U.S. Provisional Patent Application No. 63/006,994, which is incorporated herein by reference in its entirety. However, the completion design according to one or more embodiments of the present disclosure requires the use of a service string. Specifically, in one or more embodiments of the present disclosure, because of the use of a service string, there are no production valves in the inner diameter (ID) of the completion. The inclusion of a service string into the assembly results in a completion design that provides unique fluid communication flow paths in one or more embodiments of the present disclosure. For example, the fluid communication flow paths provided by the completion design of FIGS. 1-3L may include an outer annulus between the open hole and screens (i.e., where the gravel is pumped); a micro-annulus between screen wires and non-perforated base pipe (i.e., for the gravel pack fluid dehydration); a service string annulus between the service string and the outer completion string that allows for setting the top-most isolation or openhole packer; an inner-annulus between the service string concentric strings (i.e., for taking return flow); tubing, or the inner diameter (ID) of the outer completion string; and an upper-annulus above the production packer, between the casing and the tubing. In one or more embodiments of the present disclosure, the inner-annulus is connected from one zone to the next via a 4-way circulating assembly, which is further described below.

Referring specifically to FIG. 1, a system including an outer completion string 10 and an inner service string 11 according to one or more embodiments of the present disclosure is shown. In particular, FIG. 1 shows a layout of the outer completion string 10 and the inner service string 11 with their main components for a two zone completion. As shown in FIG. 1, the outer completion string 10 may include at least one isolation packer 12 or openhole packer between each well zone, separating two or more well zones. In one or more embodiments of the present disclosure, the at least one isolation packer 12 may include a melting isolating material, such as a metal or resin, for example. The well zones may include at least a bottom-most well zone in an uncased section of a wellbore and a top well zone in the uncased and cased sections of the wellbore. Of note, the outer completion string 10 according to one or more embodiments of the present disclosure may also operate in an entirely cased wellbore. Moreover, the well zones may also include any number of intermediate well zones between the bottom-most well zone and the top well zone according to one or more embodiments of the present disclosure. Each of the bottom-most well zone and any intermediate well zone includes from to top bottom an openhole or isolation packer 12, a gravel pack extension 13, blank pipe 30, a sand control assembly 16 that includes a pair of screen joints 50 coupled at a screen joint connection, and a flow control valve 18 for taking returns. Moreover, in one or more embodiments of the present disclosure, the bottom-most well zone may include a washdown shoe 24, and the top well zone may include a latch profile 20, a female inductive coupler 22, and a treatment packer 28 or control line set top packer, which may be a gravel pack packer, that is hydraulically set in casing. In one or more embodiments of the present disclosure, the top well zone also includes a gravel pack extension 13, blank pipe 30, and a sand control assembly 16 downhole of the treatment packer 28. In one or more embodiments of the present disclosure, a sand control assembly 16, blank pipe 30, and a gravel pack extension 13 are disposed uphole of the washdown shoe 24 in the bottom-most well zone. FIG. 1 also shows that the outer completion string 10 according to one or more embodiments of the present disclosure may include an electric line 32 or fiber optic line that runs from the female inductive coupler 22 to the flow control valve 18 in the bottom-most well zone.

Still referring to FIG. 1, the inner service string 11 of the completion system according to one or more embodiments of the present disclosure is configured to connect within the outer completion string 10 of the completion string, as shown in FIGS. 3A-3I, for example. As shown in FIG. 1, the inner service string 11 according to one or more embodiments of the present disclosure includes a workstring 36, which may work with or without telemetry in one or more embodiments, a set and release section 38, a power module 40, which may be a control and battery module, for example, a return valve assembly 26, a circulating assembly 14 for each well zone, and a port closure sleeve collet 42 for contingency purposes. In one or more embodiments of the present disclosure, the set and release section 38 facilitates connection (or disconnection) of the inner service string 11 within the outer completion string 10 via the latch profile 20 of the outer completion string 10. In one or more embodiments of the present disclosure, washdown, displacement, and treatment operations may be formed in the wellbore while the inner service string 11 is connected within the outer completion string 10. Because the inner service string 11 is stationary and does not move within the outer completion string 10, operational reliability of the completion system according to one or more embodiments of the present disclosure may be realized. In one or more embodiments of the present disclosure, the inner service string 11 may also include a washpipe with a stinger, for example.

Still referring to FIG. 1, the inner service string 11 according to one or more embodiments of the present disclosure is composed of a concentric strings system and a plurality of circulating assemblies 14 to allow for all completion operations to be performed without any pipe manipulation. In one or more embodiments of the present disclosure, the inner service string 11 includes an inner concentric string 44 that is concentrically arranged within the workstring 36 creating an inner-annulus 19 between the workstring 36 and the inner concentric string 44. According to one or more embodiments of the present disclosure, the inner-annulus 19 of the inner service string 11 is continuous from the circulating assembly 14 for the bottom-most well zone to the return valve assembly 26.

Still referring to FIG. 1, the completion system according to one or more embodiments of the present disclosure includes an upper completion 15 that includes a male inductive coupler 46 that is configured to connect with the female inductive coupler 22 of the outer completion string 10. According to one or more embodiments of the present disclosure, when connected to the female inductive coupler 22, the male inductive coupler 46 communicates power from the power module 40 (e.g., battery or control module) or the workstring 36 to the electric line 32, and controls the valves of the completion system (i.e., flow control valves 18 and port closure sleeves 13*a* of the gravel pack extensions 13).

Figure 2D:
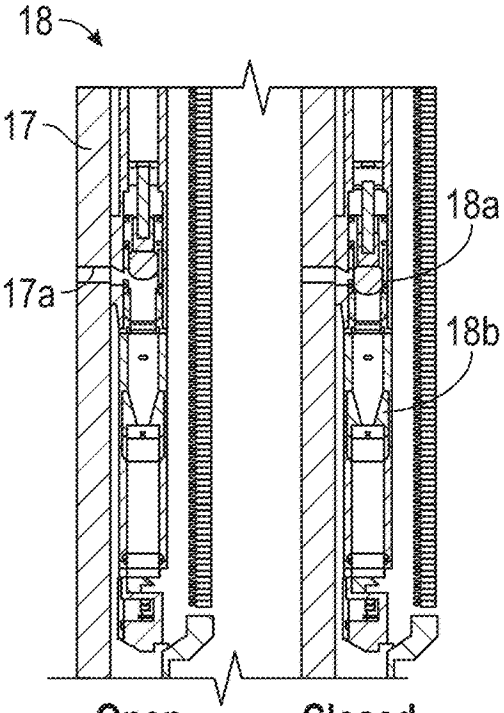
FIG. 2D shows further detail of the downhole flow control valve within the sand control assembly of FIG. 2C according to one or more embodiments of the present disclosure.
Figure 2C:
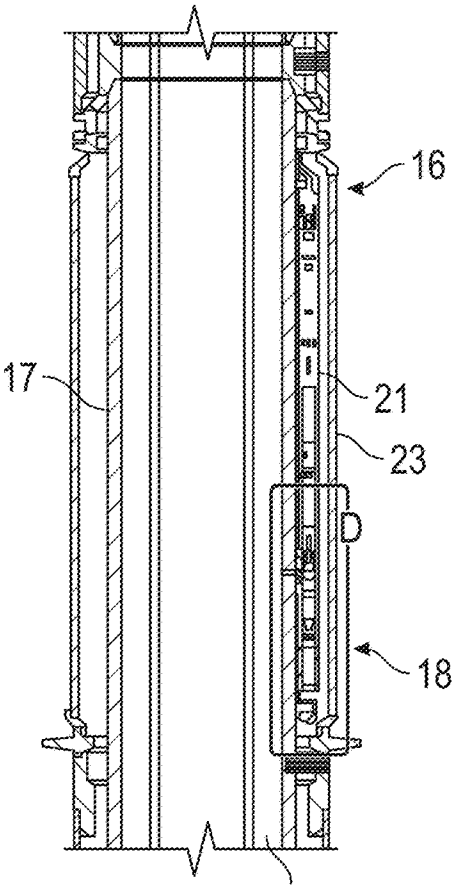
FIG. 2C shows further detail of a downhole flow control valve within a sand control assembly of the outer completion string of FIG. 1 according to one or more embodiments of the present disclosure.
Figure 2B:
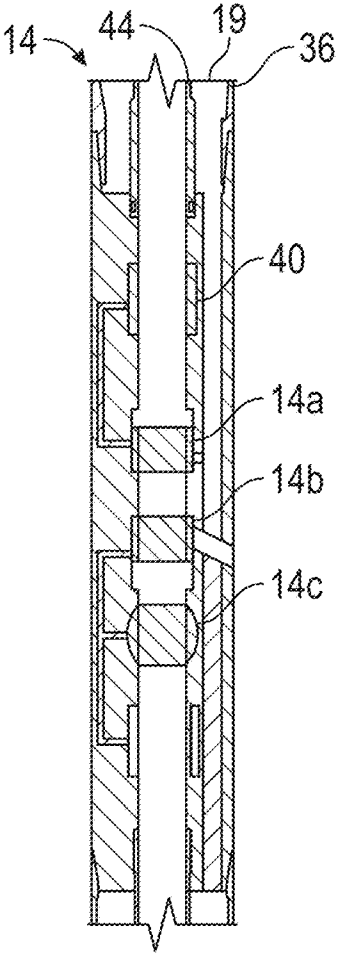
FIG. 2B shows further detail of the circulating assembly of the inner service string of FIG. 1 according to one or more embodiments of the present disclosure.
Figure 2A:
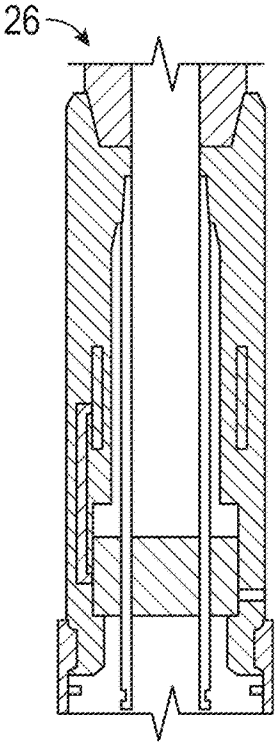
FIG. 2A shows further detail of the return valve of the inner service string of FIG. 1 according to one or more embodiments of the present disclosure.

Referring now to FIG. 2A, further detail of the return valve 26 of the inner service string 11 of the completion system of FIG. 1 according to one or more embodiments of the present disclosure is shown. The return valve 26 is a remotely operated sliding sleeve type of valve that allows communication between the upper-annulus and the inner-annulus 19 of the inner service string 11, according to one or more embodiments of the present disclosure. In one or more embodiments, the return valve 26 may be actuated electrically or hydraulically. Referring to the truth table shown in FIG. 3L, the operational sequence for the return valve 26 requires three actuations in one or more embodiments of the present disclosure: the return valve 26 is in the open position while the inner service string 11 is run-in-hole, the return valve 26 is then closed for the steps of washing down and setting the top packer 28 (i.e., the gravel pack packer or treatment packer), and the return valve 26 is then opened for treatment and related steps before the inner service string 11 is pulled out of hole before production. The return valve 26 may be remotely actuated via an electric rupture disc, according to one or more embodiments of the present disclosure. In such embodiments, the actuation command may be either sent wirelessly via pressure signals, or by using the electric line 32. Alternatively, hydraulic actuations via an open hydraulic line and a close hydraulic line are possible.

Referring now to FIG. 2B, further detail of the circulating assembly 14 of the inner service string 11 of FIG. 1 according to one or more embodiments of the present disclosure is shown. In one or more embodiments of the present disclosure, there is one circulating assembly 14, one of the key components of the completion system, per well zone to provide for all flow paths during the completion operations. In one or more embodiments of the present disclosure, the circulating assembly 14 is composed of 3 valves (e.g., a reverse valve 14*a*, a treat valve 14*b*, and an isolation valve 14*c*) that are controlled via a hydraulic-electric system. Upon reception of a command through the electric line 32, the appropriate valve of the circulating assembly 14 is cycled through the control module 40. In other embodiments of the present disclosure, the circulating assembly 14 may include a single valve that is configured to assume at least one of a reverse position, a treat position, and an isolation position.

Still referring to FIG. 2B, the circulating assembly 14 according to one or more embodiments of the present disclosure allows for pumping fluid from the inner concentric string 44 to the outer annulus (i.e., outer completing string 10 outer diameter to formation) via the treat valve 14*b*, from the inner-annulus 19 to the inner concentric string 44 via the reverse valve 14*a*, and inside the inner concentric string 44 or to isolate the inner service string 11 below via the isolation valve 14*c*. Advantageously, the 4-way connections of the circulating assembly 14 according to one or more embodiments of the present disclosure facilitate connection from one well zone to the next while preserving the inner-annulus 19 through the inner service string 11. In one or more embodiments of the present disclosure, the inner service string 11 may include concentric seal units on each side of the circulating assembly 14 to facilitate isolation between well zones.

Referring now to FIG. 2C, further detail of a flow control valve 18 inside the sand control assembly 16 of the outer completion string 10 of FIG. 1 is shown according to one or more embodiments of the present disclosure. Specifically, the flow control valve 18 may be a Schlumberger Manara valve, and the sand control assembly 16 may be a Schlumberger MZ-Xpress screen, according to one or more embodiments of the present disclosure. Further, in one or more embodiments of the present disclosure, the sand control assembly 16 may be alternate path compatible for gravel packing applications. Moreover, the flow control valve 18 may be a full bore electric flow control valve, according to one or more embodiments of the present disclosure.

Referring to FIGS. 1 and 2C, in one or more embodiments of the present disclosure, the sand control assembly 16 includes a pair of screen joints 50 coupled at a screen joint connection. Moreover, each screen joint 50 of the sand control assembly 16 according to one or more embodiments of the present disclosure includes a non-perforated base pipe 17, a filter medium 23 such as a screen disposed around the non-perforated base pipe 17, and a micro-annulus 21 between the filter medium 23 and the non-perforated base pipe 17. The sand control assembly 16 according to one or more embodiments of the present disclosure is unique at least because the micro-annulus 21 is continuous from screen joint 50 to screen joint 50. In one or more embodiments of the present disclosure, the outer completion string 10 of the completion system includes the non-perforated base pipe 17 of each screen joint 50 and additional blank pipe 30. Moreover, the sand control assembly 16 according to one or more embodiments of the present disclosure includes a feedthrough for the electric line 32 of the outer completion string 10.

In embodiments of the present disclosure where there is at least one intermediate well zone between the bottom-most well zone and the top well zone, the outer completion string 10 may include an additional sand control assembly 16, and the inner service string 11 may include an additional circulating assembly 14 disposed in the at least one intermediate well zone.

Referring to FIGS. 1, 2C, and 2D, which show further detail of the downhole flow control valve 18 in cooperation with the sand control assembly 16 of FIG. 2C according to one or more embodiments of the present disclosure, the filter medium 23 of the sand control assembly 16 is offset from the base pipe 17 through high standoff rib wires, which allow for the placement of the flow control valve 18 (based off the Manara Valve tube). Integrating the sand control assembly 16 and the flow control valve 18 in each of the well zones in this way allows for optimized production. As shown in FIG. 2D, for example, the flow control valve 18 may include a plunger 18*a* and a venturi valve 18*b* in one or more embodiments of the present disclosure. As further shown in FIG. 2D, in an open configuration, the plunger 18*a* of the flow control valve 18 is offset from a port 17*a* in the base pipe 17 of the sand control assembly 16, the port 17*a* allowing flow to the inner-annulus 19 between the concentric strings of the inner service string 11. FIG. 2D also shows that the plunger 18*a* of the flow control valve 18 shifts to obstruct the port 17*a* of the base pipe 17 so that no fluid may flow into the inner-annulus 19 in the closed configuration.

Still referring to FIGS. 1 and 2D, at a minimum, one flow control valve 18 cooperates with the sand control assembly 16 to allow for selective production and effective gravel pack placement in one or more embodiments of the present disclosure. In one or more embodiments of the present disclosure, the flow control valve 18 may be positioned inside the filter medium 23 (i.e., inside the micro-annulus 21 of the screen joint) as shown in FIGS. 2C-2D, or the flow control valve 18 may be positioned at a location next to the screen joint that is external to the micro-annulus 21 and the corresponding filter medium 23 (not shown). Moreover, the flow control valve 18 according to one or more embodiments of the present disclosure may be positioned above or below a screen joint of the sand control assembly 16. An inflow control device may be positioned in the flow control valve 18 according to one or more embodiments of the present disclosure.

Figure 3A:
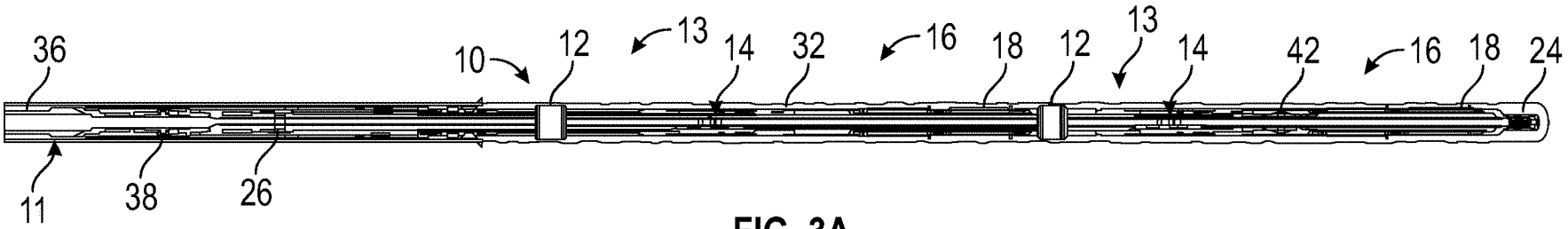
FIGS. 3A-3K show a method of completing a wellbore using an inner service string arranged inside an outer completion string according to one or more embodiments of the present disclosure.

Referring now to FIGS. 3A-3K, a method for completing a wellbore using the inner service string 11 arranged inside the outer completion string 10 according to one or more embodiments of the present disclosure is shown. After making up the lower completion and the service tool assemblies at the rotary, the inner service string 11 connected within the outer completion string 10 may be deployed into the wellbore as shown in FIG. 3A in a method according to one or more embodiments of the present disclosure. In the run-in-hole position shown in FIG. 3A, all valves of the completion system are open except for the reverse valves 14*a* of the circulation assemblies 14 and the flow control valves 18, as shown in FIG. 3L, for example. Setting the system valves of the completion system in this way facilitates pumping fluid from the workstring 36 through the ID of the inner service string 11 (i.e., the inner concentric string 44), down to and out of the washdown shoe 24 in the bottom-most well zone, and back to surface via the outer annulus of the completion system. The open hole fluid can be displaced in that same position (i.e., tubing to annulus). To allow adequate fluid filling while running in hole, the return valves 26 of the circulating assemblies 14 may be cycled in the open position according to one or more embodiments of the present disclosure.

Figure 3B:
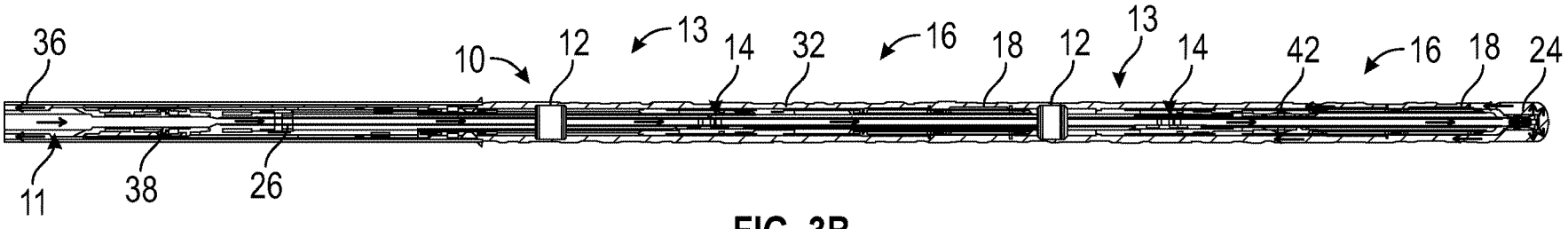

As shown in FIG. 3B, the method further includes performing a washdown operation. According to one or more embodiments of the present disclosure, during washdown, the isolation valves 14*c* of the circulating assemblies 14 are open. Further, the port closure sleeve 13*a* of the gravel pack extension 13 may be isolated by the bonded seals associated with each circulating assembly.

Figure 3C:
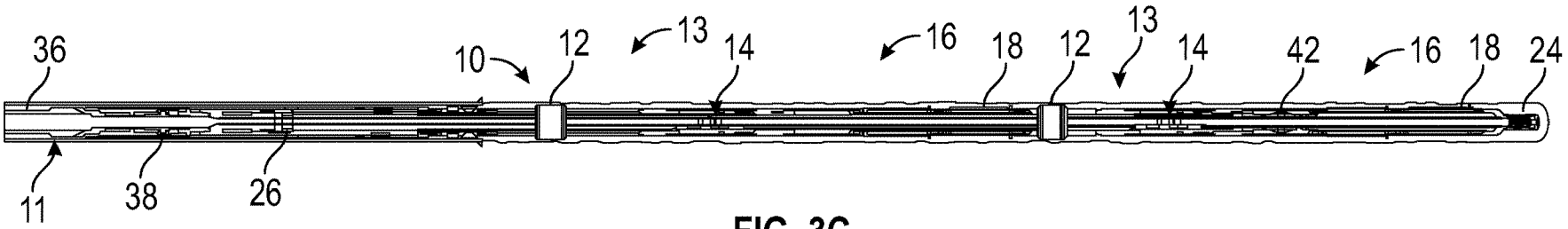

As shown in FIG. 3C, the method further includes setting the gravel pack packer 28 or top packer in one or more embodiments of the present disclosure. The gravel pack packer or top packer 28 is set via a hydraulic line or electric line 32 according to one or more embodiments of the present disclosure. As shown in FIG. 3L, for example, when the top packer 28 is set, system valves of the completion system are closed except for the isolation valves 14*c* of the circulating assemblies 14 and the port closure sleeves 13*a* of the gravel pack extensions 13.

Figure 3D:
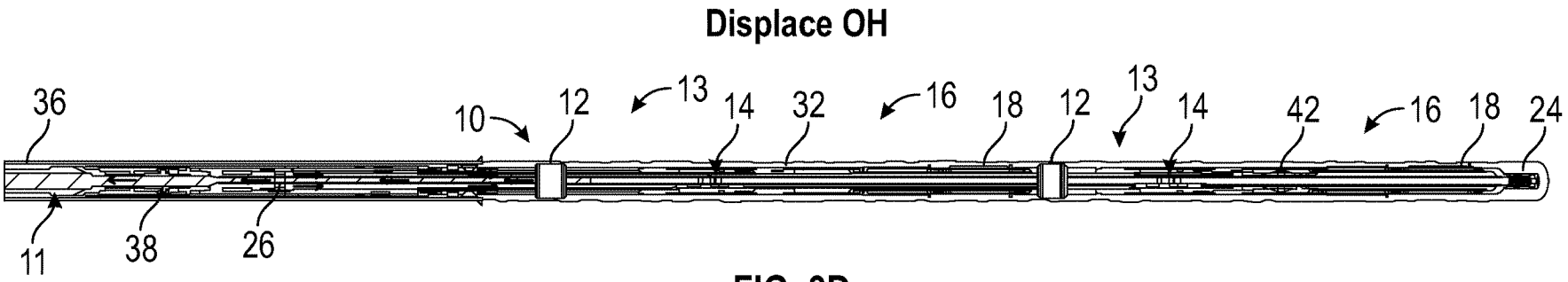

Referring now to FIG. 3D, the method further includes pumping displacement fluid through the completion system in an annulus-to-tubing direction. Advantageously, displacing the open hole in the annulus-to-tubing direction helps protect the screens 23 of the sand control assembly 16. As shown in FIG. 3L, in this position, the return valve 26 is open, the top-most treat valve 14*b* of the top circulating assembly 14 is open, and the bottom-most flow control valve 18 is open. Also, in this position, the upper isolation valve 14*c* of the circulating assembly 14 is closed. In other embodiments of the present disclosure, displacement fluid may be pumped through the completion system in a tubing-to-annulus direction.

Figure 3E:
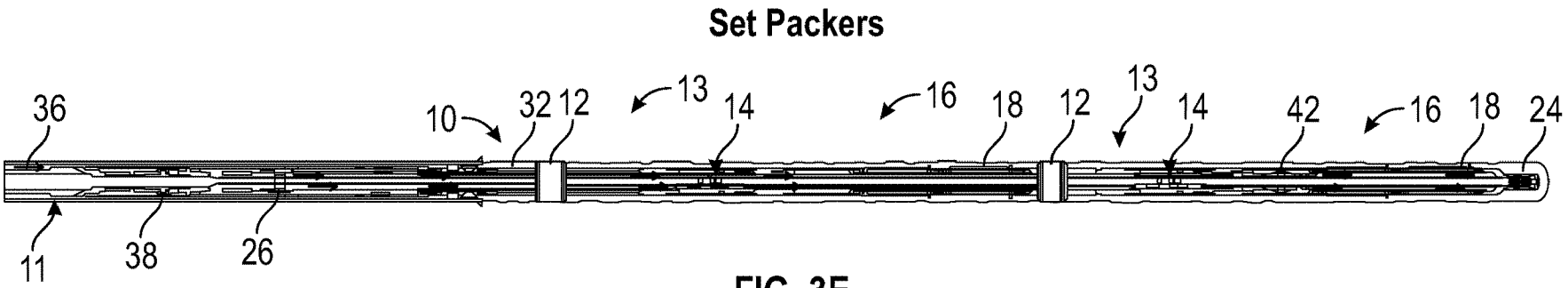

Referring now to FIG. 3E, the method further includes setting the at least one isolation packer 12. In one or more embodiments of the present disclosure, the at least one isolation packer 12 may be set hydraulically. For hydraulic setting of the at least one isolation packer 12, pressure is conveyed to the setting section by pressuring the workstring 36 annulus and opening the return valve 26, all other system valves of the completion system will remain closed except for the isolation valves 14*c* of the circulating assemblies 14. In other embodiments of the present disclosure, the at least one isolation packer 12 may be set electrically, such as by an eFire or eTrigger that is actuated via the power module 40 and the electric line 32, for example. According to one or more embodiments of the present disclosure, the plurality of isolation packers 12 in the completion string may be set simultaneously.

Figure 3F:
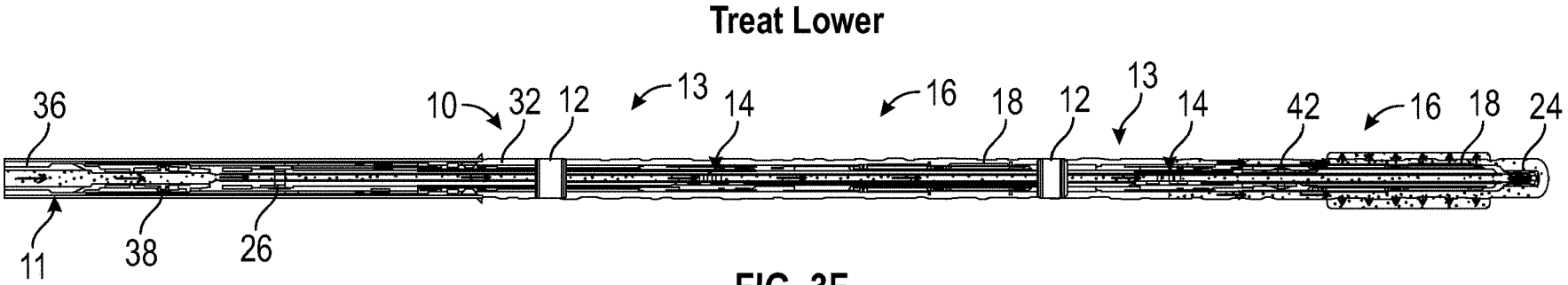

Referring now to FIG. 3F, the method further includes treating the bottom-most well zone. In one or more embodiments of the present disclosure, treating the bottom-most well zone includes performing fracturing and gravel pack operations. In one or more embodiments, an annulus blowout preventer will be closed on the workstring 36, and treatment fluid is pumped down the inner concentric string 44, out to the open hole through the treat valve 14*b* of the lower circulating assembly 14, to the flow control valve 18 in the bottom-most well zone, up the service string concentric annulus, and through the return valve 26 to surface. In one or more embodiments of the present disclosure, during this treating step, the lower isolation valve 14*c* of the circulating assembly 14 is closed, the lower treat valve 14*b* of the circulating assembly 14 is open, and the flow control valve 18 in the bottom-most well zone is open, as shown in FIG. 3L, for example.

Figure 3G:
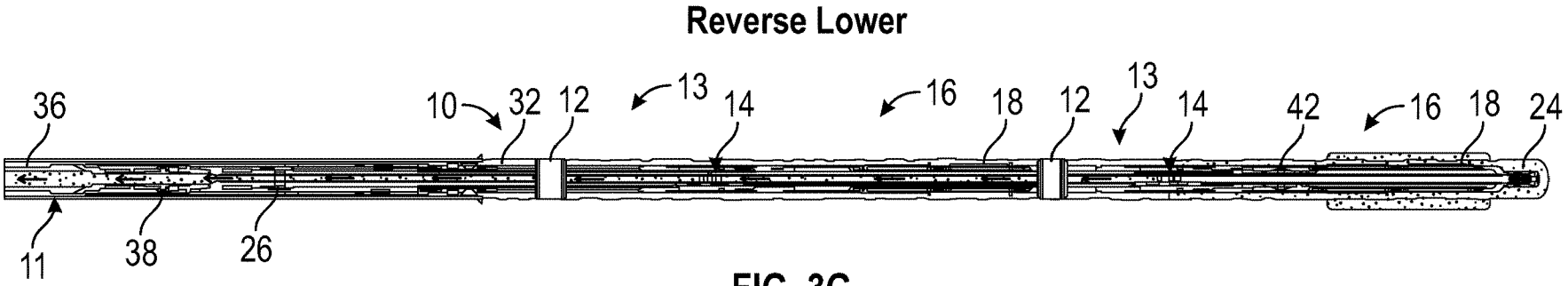

Referring now to FIG. 3G, the method further includes reversing out the bottom-most well zone. In one or more embodiments of the present disclosure, this step enables reversing out the excess slurry that remains in the tubing following the gravel pack and fracturing treatments. As shown in FIG. 3L, during this reversing out step, the isolation valve 14*c* of the lower circulating assembly is closed, and the lower reverse valve 14*a* of the circulating assembly 14 is opened. In this position, fluid can be pumped from the tubing annulus through the return valve 26 to the service string concentric annulus, to the lower reverse valves 14*a* back to the inner concentric string 44 and then the workstring 36. The formation is isolated via the isolation valve 14*c* and treat valve 14*b* of the circulating assembly 14 and the bottom-most flow control valve 18.

Figure 3H:
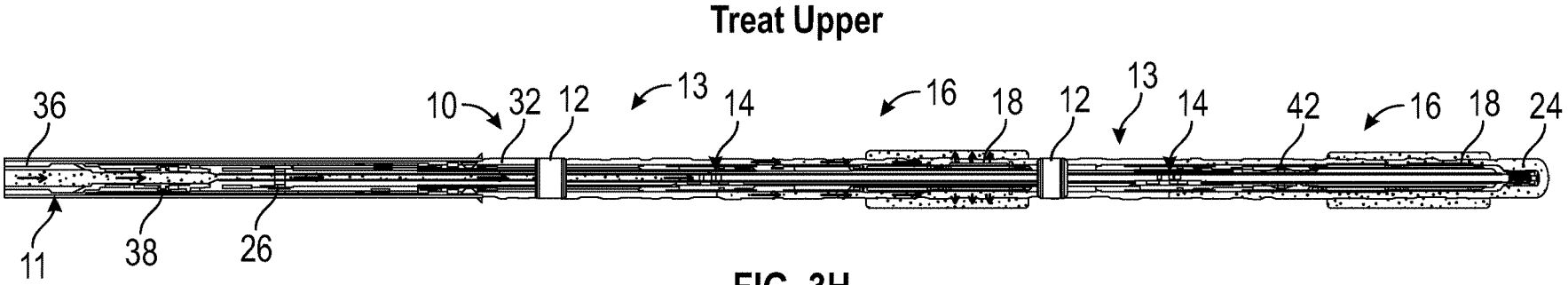
Figure 3I:
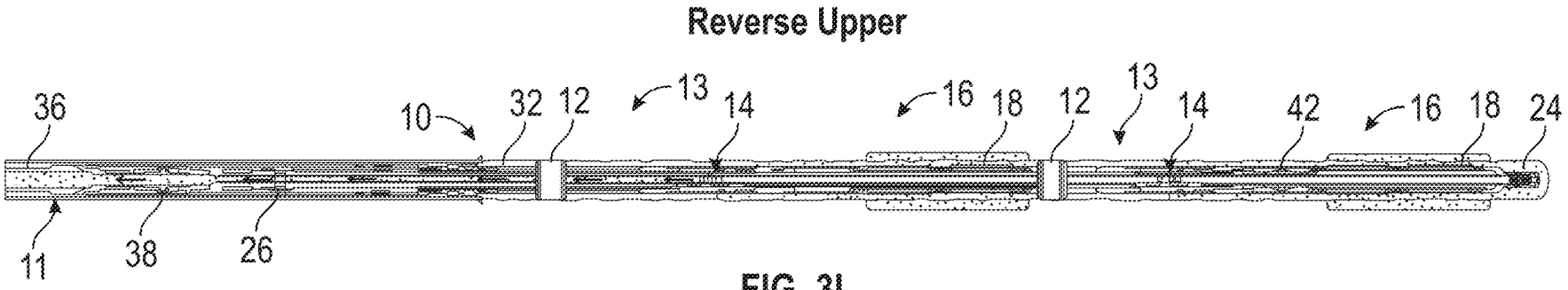

Referring now to FIGS. 3H and 3I, the method further includes treating and reversing out the top well zone. In one or more embodiments of the present disclosure, the operation continues with steps identical to those shown in FIGS. 3F and 3G with the lower circulating assembly 14 fully closed and the lower flow control valve 18 fully closed, as shown in FIG. 3L, for example. That is, in the method according to one or more embodiments of the present disclosure, open hole or closed hole gravel packing/frac packing treatment operations and subsequent reverse out operations may be performed for a given zone, for each zone to be completed.

Figure 3J:
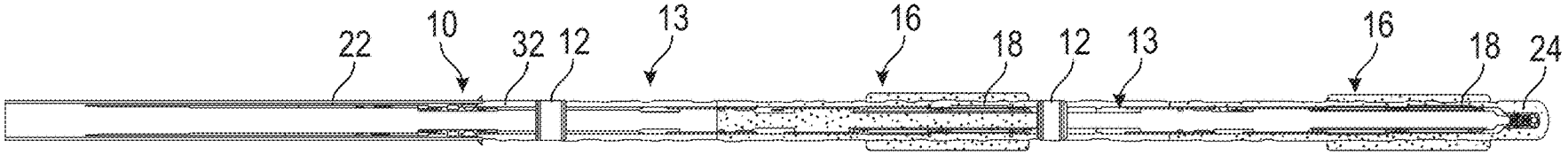

Referring now to FIG. 3J, the method further includes pulling out the inner service string 11 from the wellbore. As shown in FIG. 3J, the outer completion string 10 remains in the wellbore. As shown in FIG. 3L, although the outer completion string 10 remains in the wellbore, the port closure sleeves 13*a* of the gravel pack extensions 13 and the flow control valves 18 are closed.

Figure 3K:
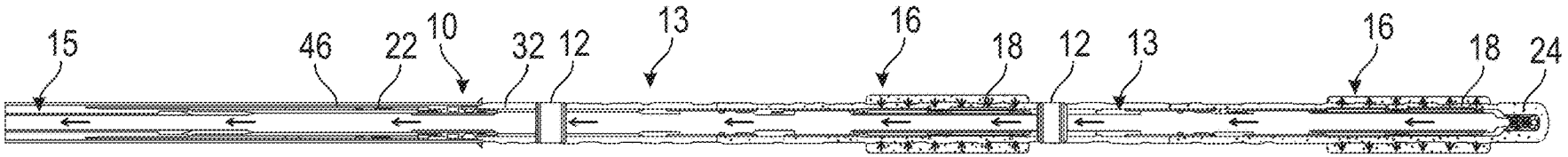

Referring now to FIG. 3K, the method further includes running the upper completion 15 in the wellbore and connecting the male inductive coupler 46 of the upper completion 15 with the female inductive coupler 22 of the outer completion string 10. Thereafter, a production packer in the top well zone of the outer completion string 10 is set to enable production through an inner diameter of the system to be produced at surface, as shown in FIG. 3K. During this step of the method, as shown in FIG. 3L, the flow control valves 18 are opened. According to one or more embodiments of the present disclosure, the opening of the flow control valves 18 is controlled to regulate the reservoir flow. In one or more embodiments of the present disclosure, control of the flow control valves 18 occurs via the electric line 32 to the inductive coupler 22, 46, and then the lower completion system.

FIG. 4-FIG. 6M relate to a completion design for a two trip frac packing completion with integrated flow control valves. The lower completion string is lowered in the hole and set, and all sand control treatment operations are performed with a service string moving inside the completion system from setting packers until the service string is POOH. Subsequently, an upper completion string is lowered with a male inductive coupler. In one or more embodiments of the present disclosure, the connection between the upper and lower completion string may be enabled via Schlumberger's Inductive Coupler, for example. Because the service string is moving inside the completion system in this embodiment of the present disclosure, treatment operations may proceed at a higher rate. Moreover, the moving service string does not shift sleeves in one or more embodiments of the present disclosure, except for the port closure sleeve, as needed as a contingency. In one or more embodiments of the present disclosure, the moving service string does not provide for a return flow path. As such, embodiments of the present disclosure having the moving service string are solely fracturing completion systems.

For example, the fluid communication flow paths provided by the completion design of FIGS. 4-6M may include an outer annulus between the open hole and screens (i.e., where the gravel is pumped); a micro-annulus between screen wires and non-perforated base pipe (i.e., for the gravel pack fluid dehydration); a service string annulus between the service string and the outer completion string that allows for pumping from annulus to tubing; a service string ID that serves as a conduit to pump fluid from the workstring; and an upper-annulus above the production packer, between the casing and the tubing.

Figure 4:
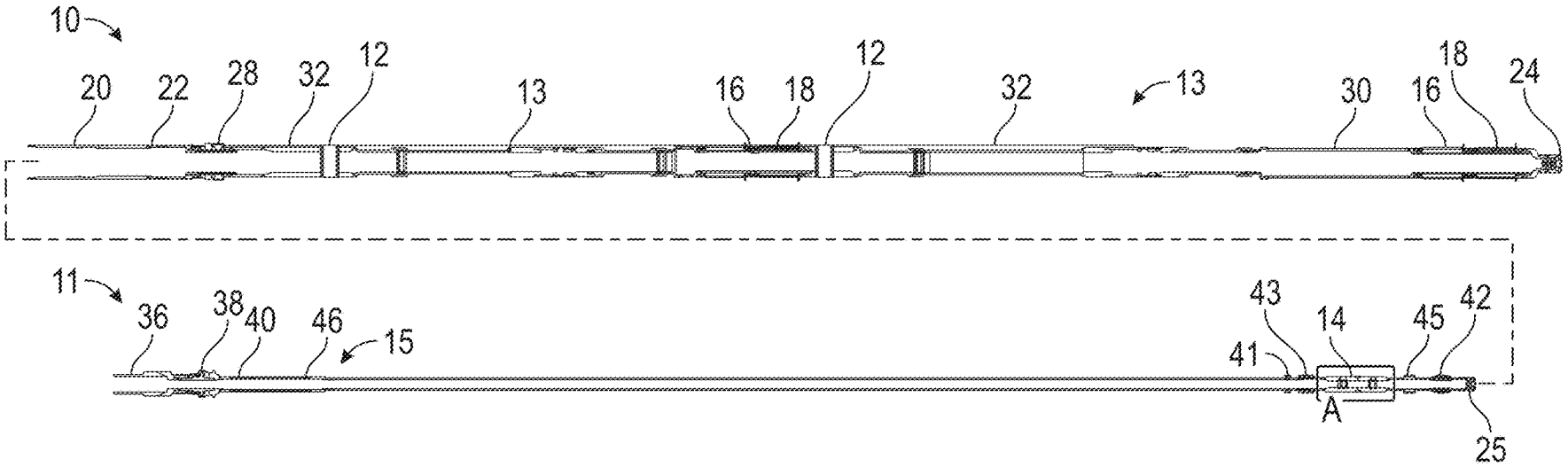
FIG. 4 shows a system including an outer completion string and a movable inner service string according to one or more embodiments of the present disclosure.

Referring specifically to FIG. 4, a system including an outer completion string 10 and an inner service string 11 according to one or more embodiments of the present disclosure is shown. In particular, FIG. 4 shows a layout of the outer completion string 10 and the inner service string 11 with their main components for a two zone completion. As shown in FIG. 4, the outer completion string 10 may include at least one isolation packer 12 or openhole packer between each well zone, separating two or more well zones. In one or more embodiments of the present disclosure, the at least one isolation packer 12 may include a melting isolating material, such as a metal or resin, for example. Moreover, in one or more embodiments of the present disclosure, the at least one isolation packer 12 may include a position indicator to indicate the position of the inner service string 11 as it moves within the outer completion string 10, to be described later. The well zones may include at least a bottom-most well zone in an uncased section of a wellbore and a top well zone in the uncased and cased sections of the wellbore. Of note, the outer completion string 10 according to one or more embodiments of the present disclosure may also operate in an entirely cased wellbore. Moreover, the well zones may also include any number of intermediate well zones between the bottom-most well zone and the top well zone according to one or more embodiments of the present disclosure.

Each of the bottom-most well zone and any intermediate well zone includes from top to bottom an openhole or isolation packer 12, a treatment extension 13, blank pipe 30, and a sand control assembly 16 that includes a pair of screen joints 50 coupled at a screen joint connection, and a flow control valve 18 for taking returns. Moreover, in one or more embodiments of the present disclosure, the bottom-most well zone may include a washdown shoe 24, and the top well zone may include a latch profile 20, a female inductive coupler 22, and a treatment packer 28 or control line set top packer that is electrically set in casing, i.e., via eFire or eTrigger, for example. In one or more embodiments of the present disclosure, the top well zone may also include a sand control assembly 16 and a treatment extension 13 that are disposed downhole of the treatment packer 28. In one or more embodiments of the present disclosure, a sand control assembly 16, blank pipe 30, and treatment extension 13 are disposed uphole of the washdown shoe 24 in the bottom-most well zone. FIG. 4 also shows that the outer completion string 10 according to one or more embodiments of the present disclosure may include an electric line 32 or fiber optic line that runs from the treatment packer 28 to the treatment extension 13 in the bottom-most well zone of the outer completion string 10.

Still referring to FIG. 4, in one or more embodiments of the present disclosure, the sand control assembly 16 includes a pair of screen joints coupled at a screen joint connection. Moreover, each screen joint of the sand control assembly 16 according to one or more embodiments of the present disclosure includes a non-perforated base pipe 17, a filter medium 23 such as a screen disposed around the non-perforated base pipe 17, and a micro-annulus 21 between the filter medium 23 and the non-perforated base pipe 17. The sand control assembly 16 according to one or more embodiments of the present disclosure is unique at least because the micro-annulus 21 is continuous from screen joint to screen joint. In one or more embodiments of the present disclosure, the outer completion string 10 of the completion system includes the non-perforated base pipe 17 of each screen joint and additional blank pipe 30. Moreover, the sand control assembly 16 according to one or more embodiments of the present disclosure includes a feedthrough for the electric line 32 of the outer completion string 10.

In embodiments of the present disclosure where there is at least one intermediate well zone between the bottom-most well zone and the top well zone, the outer completion string 10 may include an additional sand control assembly 16 and an additional treatment extension 13 disposed in the at least one intermediate well zone.

Still referring to FIG. 4, the screen joints of the sand control assembly 16 may or may not include a flow control valve 18, as per reservoir characteristics, according to one or more embodiments of the present disclosure. In one or more embodiments of the present disclosure, the bottom-most screen joint of the sand control assembly 16 may include a flow control valve 18 integrated with the sand control assembly 16. As previously described, the flow control valve 18 may be based on Schlumberger's Manara valve, for example.

Still referring to FIG. 4, the inner service string 11 of the completion system according to one or more embodiments of the present disclosure is configured to movably connect within the outer completion string 10 of the completion system, as shown in FIGS. 6A-6L, for example. As shown in FIG. 4, the inner service string 11 according to one or more embodiments of the present disclosure includes a workstring 36, which may work with or without telemetry in one or more embodiments, a set and release section 38, a power module 40, which may be a control and battery module, for example, a single circulating assembly 14 with hydraulic treating 14*b* and reverse valves 14*a*, a port closure sleeve collet 42 for contingency purposes, and a flow deactivated washdown shoe 25. In one or more embodiments of the present disclosure, the set and release section 38 facilitates connection (or disconnection) of the inner service string 11 within the outer completion string 10 via the latch profile 20 of the outer completion string 10. In one or more embodiments of the present disclosure, the inner service string 11 may also include at least one of a plurality of cups 43, and a plurality of seal units 45 next to the single circulating assembly 14 to facilitate isolation. The inner service string may also include a hydraulic hold down 41 associated with the single circulating assembly 14, as shown in FIG. 4, for example.

Figure 5A:
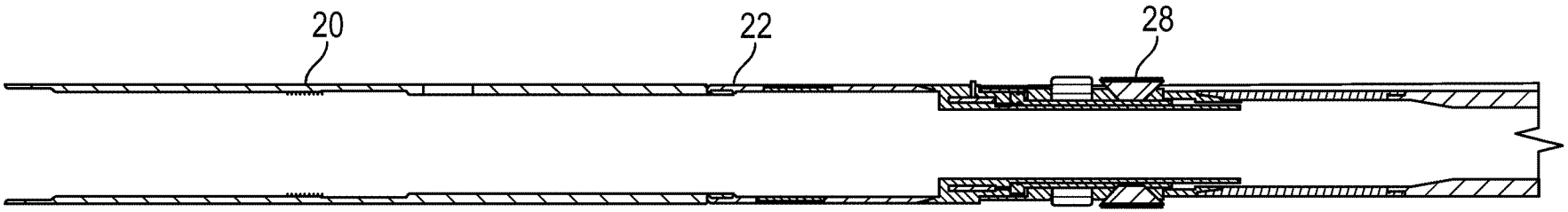
FIGS. 5A-5C show further detail of the top well zone of the outer completion string in operation with the movable inner service string according to one or more embodiments of the present disclosure.

Referring now to FIG. 5A, further detail of the outer completion string 10 in the top well zone is shown, including the latch profile 20, the female inductive coupler 22, and the treatment packer 28. In one or more embodiments of the present disclosure, the female inductive coupler 22 may include a receiver and a battery module, as shown in FIG. 5A, for example. In one or more embodiments of the present disclosure, the receiver in the female inductive coupler 22 is used to control the flow control valve 18 while the inner service string 11 is moving within the outer completion string 10.

Figure 5B:
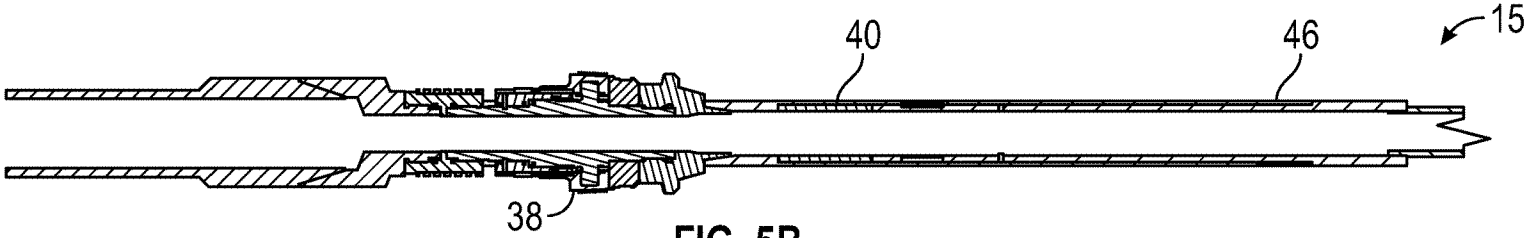

Referring now to FIGS. 4, 5A, and 5B, the completion system according to one or more embodiments of the present disclosure includes an upper completion 15 that includes a male inductive coupler 46 that is configured to connect with the female inductive coupler 22 of the outer completion string 10. According to one or more embodiments of the present disclosure, when connected to the female inductive coupler 22, the male inductive coupler communicates power from the power module 40 (e.g., battery or control module) or the workstring 36 to the electric line 32, and controls the valves of the completion system (i.e., flow control valves 18) while running-in-hole.

Figure 5C:
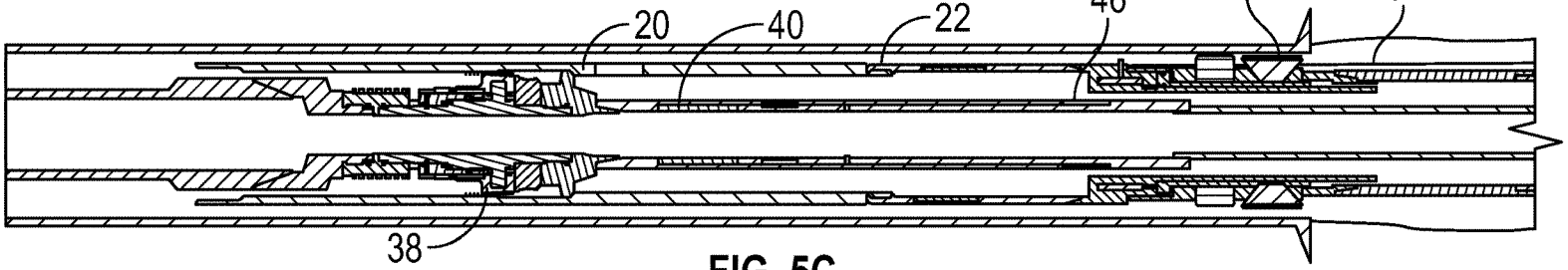

Referring to FIGS. 5A-5C, the treatment packer 28 may be set with an electric rupture disc (ERD) according to one or more embodiments of the present disclosure. In one or more embodiments of the present disclosure, the treatment packer 28 may be a multi-port packer, such as Schlumberger's XMP, for example. In such embodiments of the present disclosure, the actuation mechanism may be modified to include two atmospheric chambers. Triggering of the ERD can flood one of the atmospheric chambers with hydrostatic pressure and allow the piston to work against the other atmospheric chamber, setting the treatment packer 28. In one or more embodiments of the present disclosure, actuation may be achieved either wirelessly using pressure signals or through a signal conveyed by the telemetry on the workstring 36, for example. Pressure signals may be applied in the run-in-hole position of the completion system by closing the flow deactivated washdown shoe 25 of the inner service string 11.

Figure 5D:
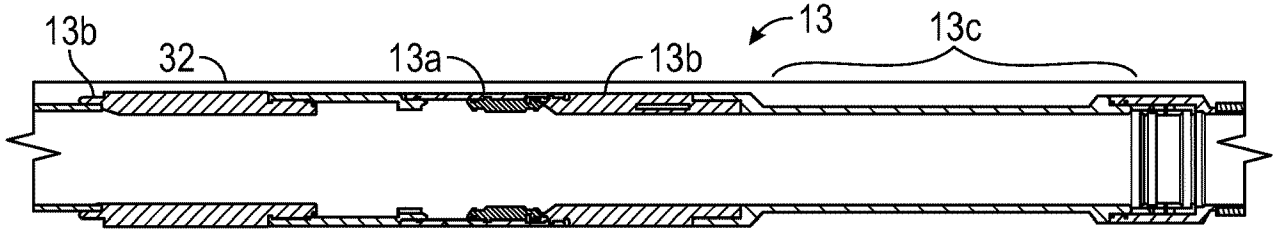
FIG. 5D shows further detail of a treatment extension of the outer completion string according to one or more embodiments of the present disclosure.

Referring now to FIG. 5D, further detail of a treatment extension 13 of the outer completion string 10 according to one or more embodiments of the present disclosure is shown. As shown in FIG. 5D, the treatment extension 13 may include a port closure sleeve 13*a*, a plurality of polish bore receptacles (PBR) 13*b*, and a position locator 13*c*. According to one or more embodiments of the present disclosure, position indicating is accomplished via set down weight. In operation, upon screen out, the port closure sleeve 13*a* is closed. In one or more embodiments of the present disclosure, the actuation principle for closing the port closure sleeve 13*a* may rely on an ERD. In one or more embodiments of the present disclosure, the command may be sent wirelessly to the receiver, and relayed to the port closure sleeve 13*a* using the electric line 32.

Figure 5E:
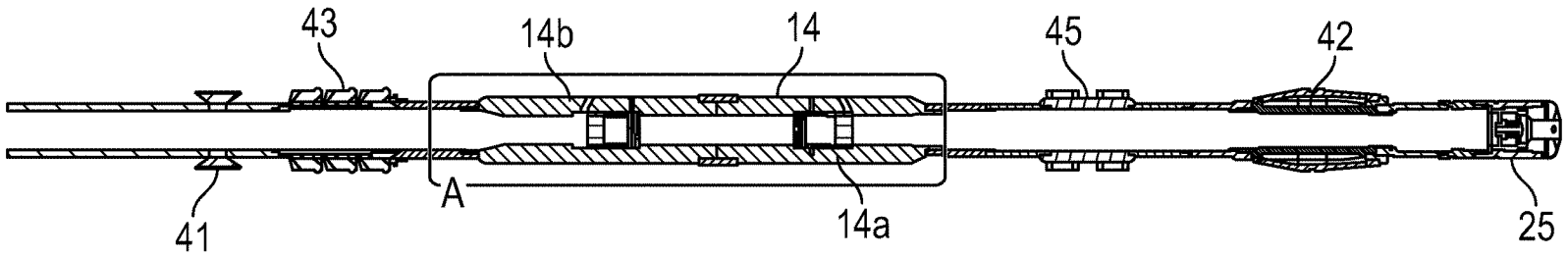
FIGS. 5E-5G show further detail of a circulating assembly of the movable inner service string in operation with the outer completion string according to one or more embodiments of the present disclosure.
Figure 5F:
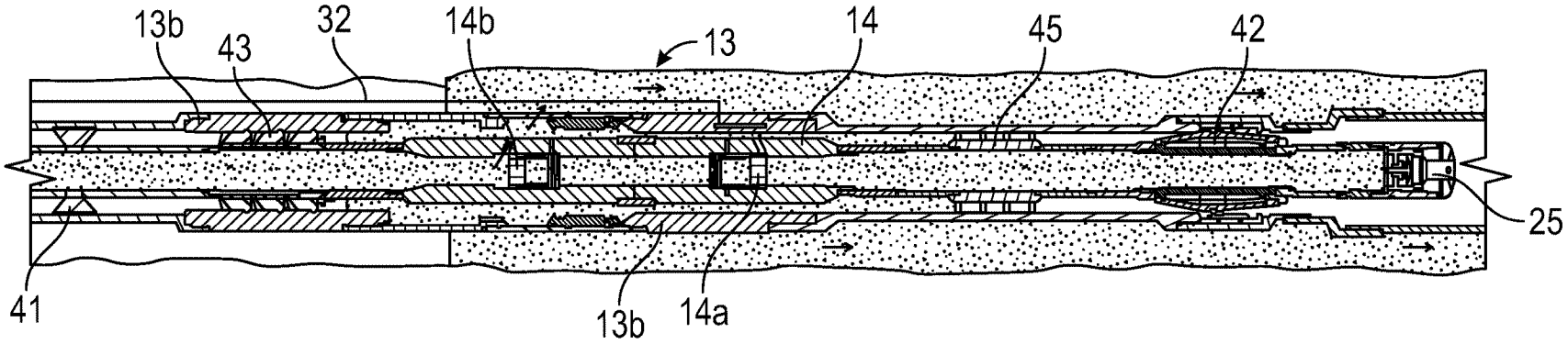
Figure 5G:
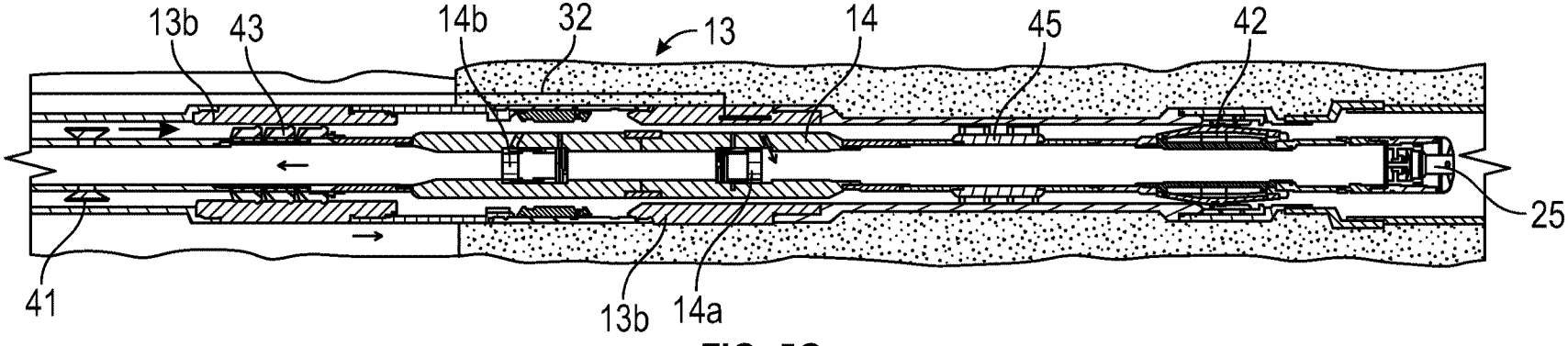

Referring now to FIGS. 5E-5G, further detail of the single circulating assembly 14 of the movable inner service string 11 in operation with the outer completion string 10 according to one or more embodiments of the present disclosure is shown. In one or more embodiments of the present disclosure, the single circulating assembly 14 of the movable inner service string 11 is a hydraulically actuated shifting tool. As shown in FIG. 5E, the single circulating assembly 14 may include a reverse valve 14*a* and a treat valve 14*b* in one or more embodiments of the present disclosure. Alternatively, the single circulating assembly 14 may include a single valve that is configured to assume at least one of a reverse position and a treat position. In one or more embodiments of the present disclosure, the valves of the single circulating assembly 14 may be controlled via a hybrid hydraulic electric system, for example.

Referring now to FIG. 5F, the single circulating assembly 14 of the movable inner service string 11 is shown in operation in a treating position. As specifically shown in FIG. 5F, the single circulating assembly 14 of the movable inner service string 11 is shown in operation within the treatment extension 13 of the outer completion string 10. In one or more embodiments of the present disclosure, once pressure increases above a certain threshold, the flow deactivated washdown shoe 25 closes. Additional pressure in the ID opens the treating valve 14*b* of the single circulating assembly 14, and actuates the slip buttons of the hydraulic hold down 41.

Referring now to FIG. 5G, the single circulating assembly 14 of the movable inner service string 11 is shown in operation in a reverse position. As specifically shown in FIG. 5G, the single circulating assembly 14 of the movable inner service string 11 is shown in operation within the treatment extension 13 of the outer completion string 10. In one or more embodiments of the present disclosure, the bonded seals 45 of the inner service string 11 are landed in the PBR 13*b* of the treatment extension 13. Once annular pressure is applied, the reverse valve 14*a* of the single circulating assembly 14 is opened (rate needs to be above the washdown shoe 25 deactivation threshold), and fluid can flow up through the tubing. In one or more embodiments of the present disclosure, the open/close collet 42 of the inner service string 11 may be used to manipulate the port closure sleeve 13*a* of the treatment extension 13 as a contingency.

Figure 6A:
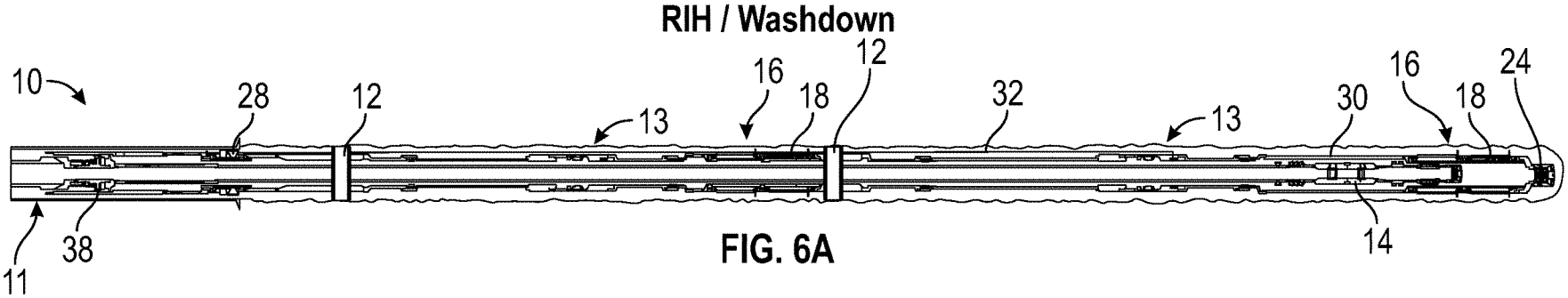
FIGS. 6A-6L show a method of completing a wellbore using an inner service string movable inside an outer completion string according to one or more embodiments of the present disclosure.

Referring now to FIGS. 6A-6L, a method for completing a wellbore using the inner service string 11 movably arranged inside the outer completion string 10 according to one or more embodiments of the present disclosure is shown. After making up the lower completion and service tool assemblies at the rotary, the inner service string 11 connected within the outer completion string 10 may be deployed into the wellbore as shown in FIG. 6A in a method according to one or more embodiments of the present disclosure. In the run-in-hole position shown in FIG. 6A, all of the valves of the completion system are closed. This allows fluid to be pumped from the workstring 36 through the ID of the inner service string 11, down to and out of the washdown shoe 24 in the bottom-most well zone, and back to surface via the completion annulus. The open hole fluid can be displaced in that same position (i.e., tubing to annulus). To allow adequate fluid filling while running in hole, the flow control valves 18 may be in the open position according to one or more embodiments of the present disclosure. In one or more embodiments of the present disclosure, the method may also include pumping displacement fluid around all of the packers in the completion system in a tubing-to-annulus direction.

Figure 6B:
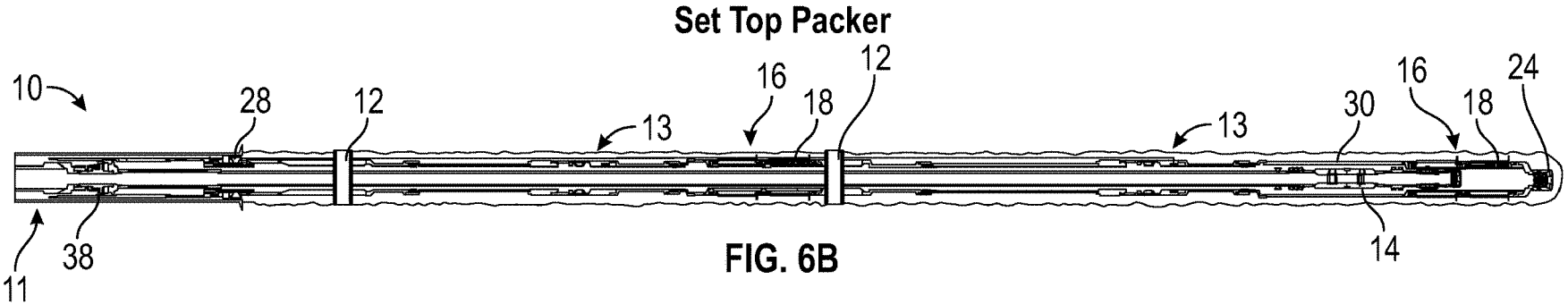

As shown in FIG. 6B, the method further includes setting the treatment packer 28 or top packer in one or more embodiments of the present disclosure. The treatment packer 28 is set electrically via the electric line 32 according to one or more embodiments of the present disclosure. As shown in FIG. 6M, during this step, all system valves of the completion system are closed.

Figure 6C:
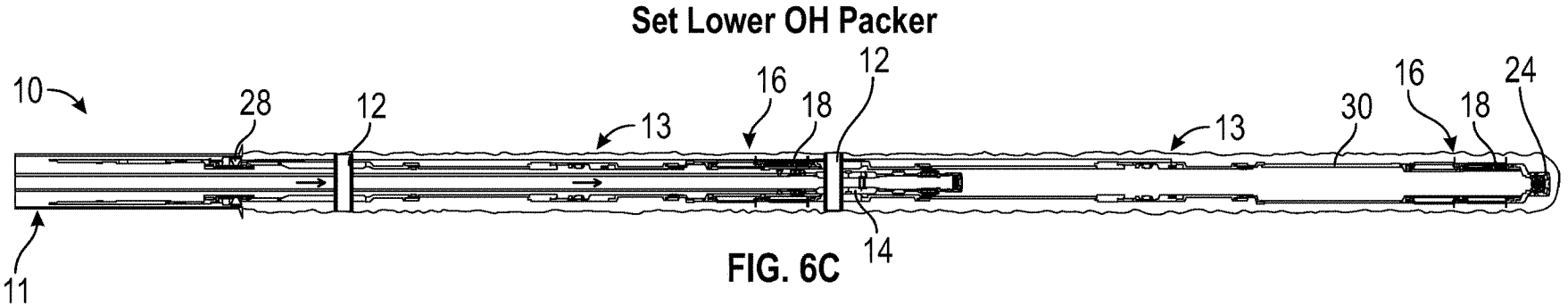

Thereafter, the inner service string 11 may be released in one or more embodiments of the present disclosure so that the inner service string 11 may be positioned adjacent the indicator of the bottom-most isolation packer 12. As shown in FIG. 6C, the method further includes setting the bottom-most isolation packer 12 by applying pressure in an inner diameter of the inner service string 11 in one or more embodiments of the present disclosure. That is, in one or more embodiments of the present disclosure, the bottom-most isolation packer 12 is hydraulically set. The bottom-most isolation packer 12 and other isolation packers 12 in the completion system are set individually prior to well zone treatment in one or more embodiments of the present disclosure. Pressure is conveyed to the setting section by positioning the inner service string 11 adjacent the bottom-most isolation packer 12 using the position indicator therein. Alternatively, the isolation packers 12 according to one or more embodiments of the present disclosure may be set electrically, such as by eFire actuated via the power module 40 and electric line 32 to the isolation packer 12. As shown in FIG. 6M, during this step of the method according to one or more embodiments of the present disclosure, the treat valve 14*b* of the single circulating assembly 14 of the inner service string 11 is open, and the flow control valve 18 in the bottom-most well zone is open.

Figure 6D:
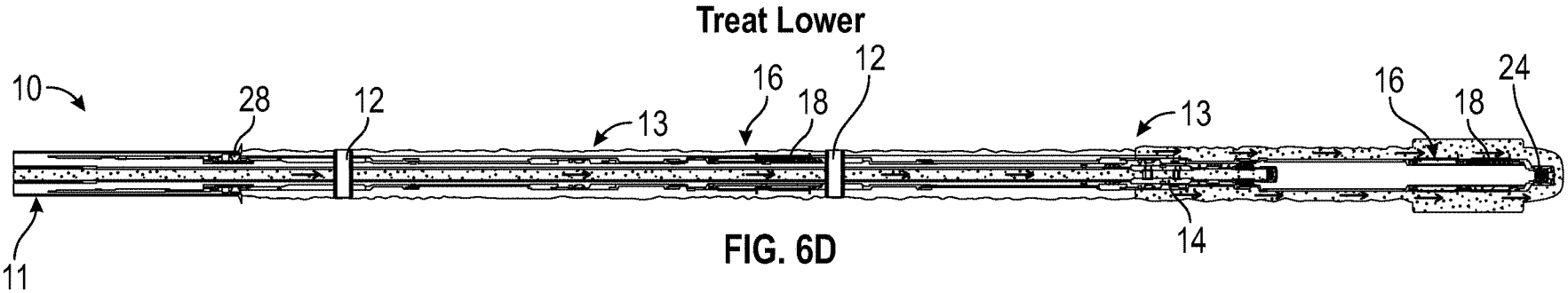

Thereafter, the inner service string 11 may be positioned with the position indicator in the treatment extension 13 located in the bottom-most well zone in one or more embodiments of the present disclosure. As shown in FIG. 6D, the method further includes treating the bottom-most well zone. In one or more embodiments of the present disclosure, treating the bottom-most well zone includes performing a fracturing operation. In one or more embodiments of the present disclosure, with the inner service string 11 positioned in the treatment extension 13 located in the bottom-most well zone, the annular BOP may remain opened, and potential leaks may be monitored (can be achieved with BOP closed and choke opened). During this step, treatment fluid is pumped down the inner service string 11 and out to the openhole through the port closure sleeve 13*a* of the treatment extension 13. The flow control valve 18 in the bottom-most well zone is kept open to equalize pressure around the valve, as shown in FIG. 6M, for example.

Figure 6E:
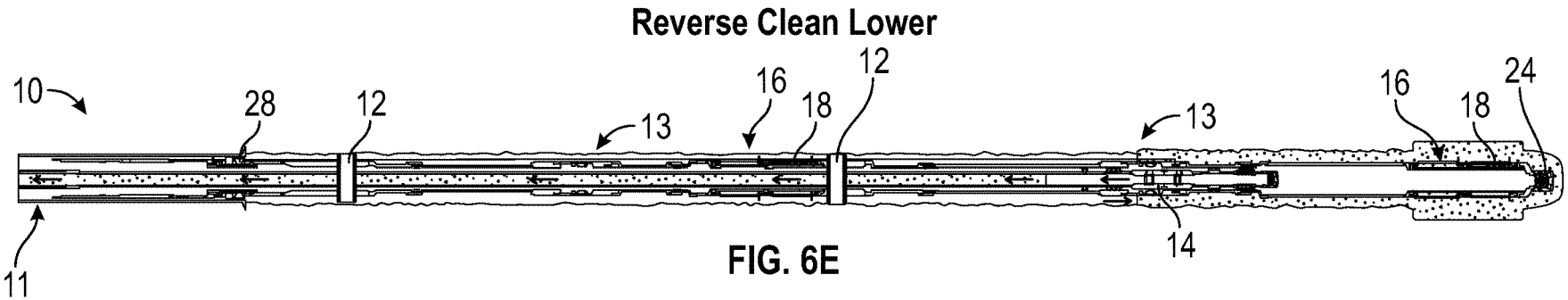
Figure 6F:
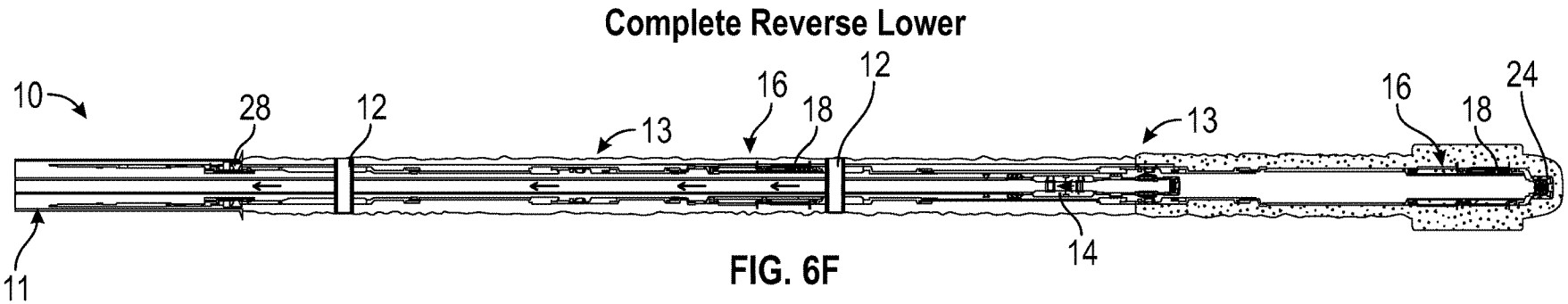
Figure 6G:
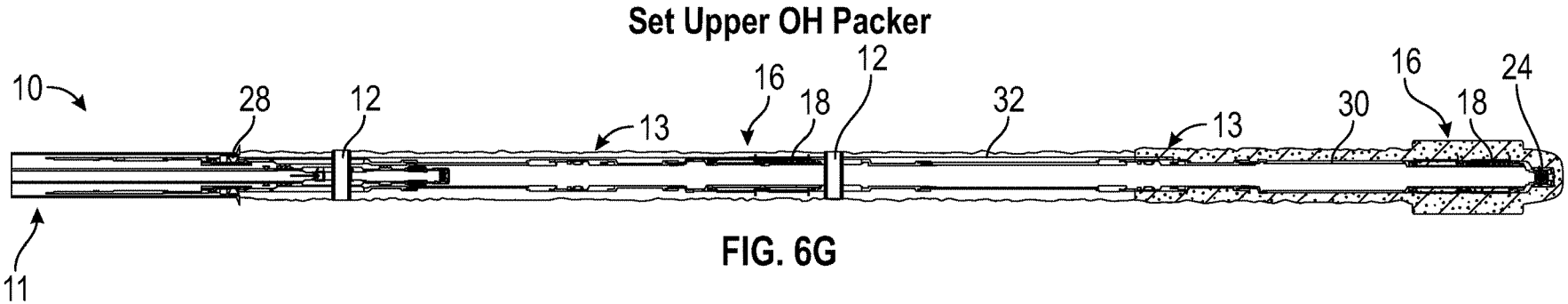
Figure 6H:
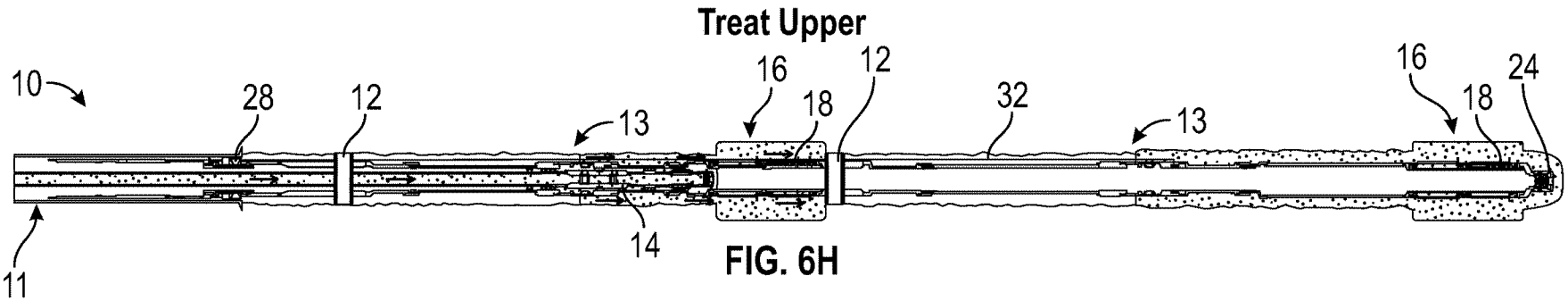
Figure 6I:
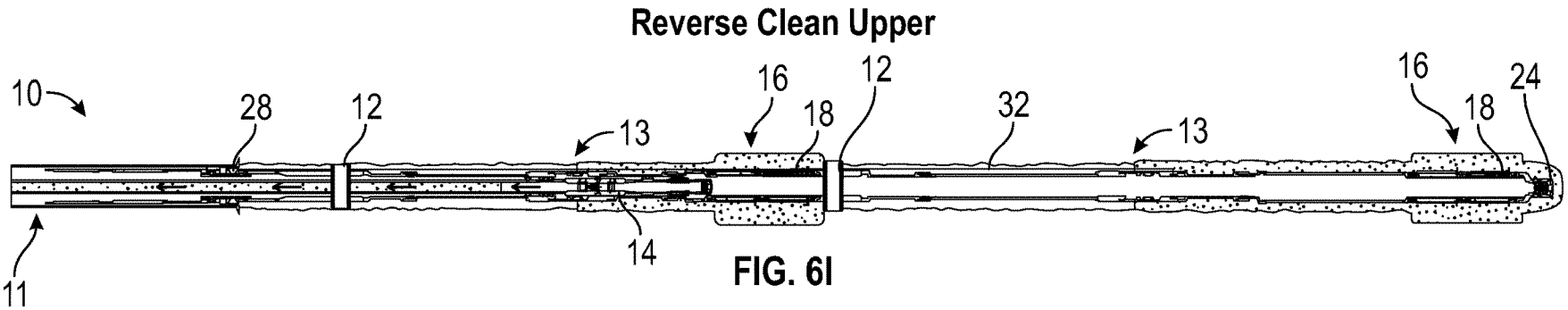
Figure 6J:
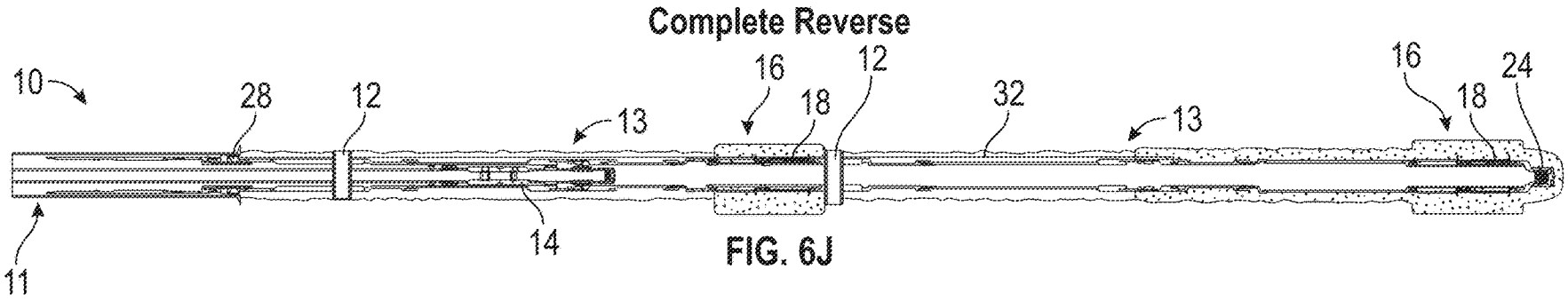

Referring now to FIGS. 6E and 6F, the method further includes reversing out and cleaning the bottom-most well zone. In one or more embodiments of the present disclosure, this step enables reversing out the excess slurry that remains in the tubing following the fracturing treatment. During this step, the inner service string 11 is still located in the treatment extension 13 according to one or more embodiments of the present disclosure. As shown in FIG. 6M, during this step, the port closure sleeve 13*a* of the treatment extension 13 and the flow control valve 18 of the bottom-most well zone are closed in one or more embodiments of the present disclosure. These system valves may be closed via an electric signal transmitted by the electric line 32, for example. Fluid may be pumped from the tubing annulus around the plurality of cups 43 to the inner diameter of the inner service string 11 and then workstring 36. In this position, the inner service string 11 may be cleaned. Thereafter, the inner service string 11 may be picked up and positioned above the treatment extension 13. In this position, the plurality of cups 43 of the inner service string 11 may be cleared of any restrictions.

Referring now to FIGS. 6G-6J, the method further includes positioning the inner service string 11 adjacent the top isolation packer 12, setting the top isolation packer 12, positioning the inner service string 11 in the treatment extension 13 in the top well zone, treating the top well zone, reversing out and cleaning the top well zone, and positioning the inner service string 11 above the treatment extension 13 in the top well zone. In one or more embodiments of the present disclosure the operation continues in the top well zone with steps identical to those previously described with respect to the bottom-most well zone. As shown in FIG. 6M, during the step of setting the top isolation packer, the treat valve 14*b* of the single circulating assembly 14 of the inner service string 11 is opened, the reverse valve 14*a* is closed, and the flow control valve 18 in the top well zone is opened. During the treating step of the top well zone, the treat valve 14*b* remains open, the port closure sleeve 13*a* of the treatment extension 13 is opened, and the flow control valve 18 in the top well zone remains open, as shown in FIG. 6M, for example. During the reverse/clean and complete reverse steps of the top well zone, the treat valve 14*b* of the single circulating assembly 14 is closed, the reverse valve 14*a* is opened, and the port closure sleeve 13*a* of the treatment extension 13 and the flow control valve 18 of the top well zone are closed, as shown in FIG. 6M, for example. That is, in the method according to one or more embodiments of the present disclosure, open hole or closed hole frac packing treatment operations and subsequent reverse/clean and complete reverse operations may be performed for a given zone, for each zone to be completed.

Figure 6K:
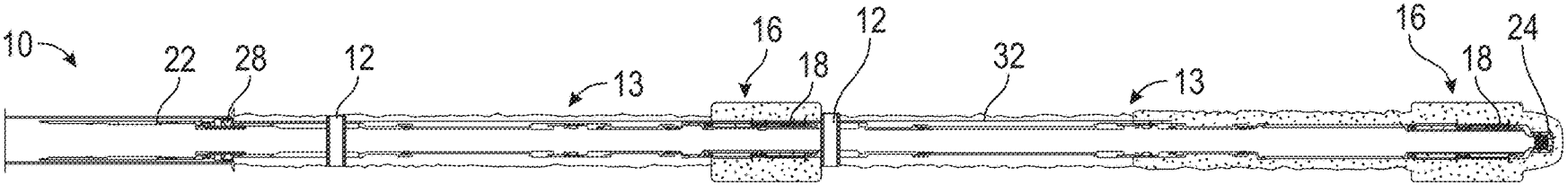

Referring now to FIG. 6K, the method further includes pulling out the inner service string 11 from the wellbore. As shown in FIG. 6K, the outer completion string 10 remains in the wellbore. As shown in FIG. 6M, although the outer completion string 10 remains in the wellbore, the port closure sleeves 13*a* of the treatment extensions 13 and the flow control valves 18 are closed.

Figure 6L:
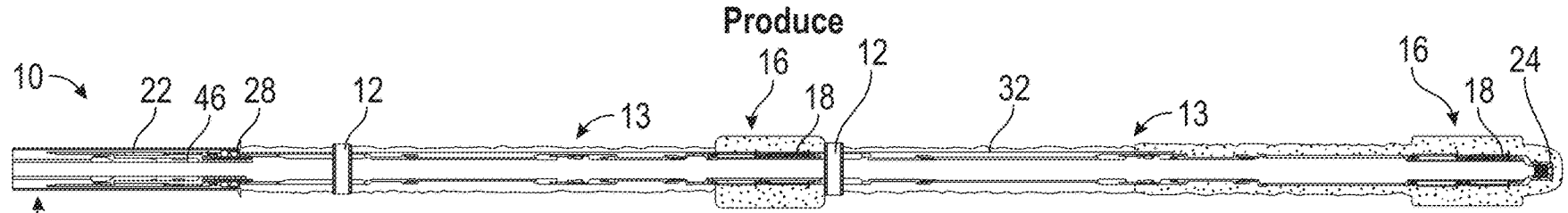

Referring now to FIG. 6L, the method further includes running the upper completion 15 in the wellbore and connecting the male inductive coupler 46 of the upper completion 15 with the female inductive coupler 22 of the outer completion string 10. Thereafter, a production packer in the top well zone of the outer completion string 10 is set to enable production through an inner diameter of the system to be produced at surface, as shown in FIG. 6L. During this step of the method, as shown in FIG. 6M, the flow control valves 18 are opened. According to one or more embodiments of the present disclosure, the opening of the flow control valves 18 is controlled to regulate the reservoir flow. In one or more embodiments of the present disclosure, control of the flow control valves 18 occurs via the electric line 32 to the inductive coupler 22, 46, and then the lower completion system.

FIG. 7-FIG. 9J relate to a completion design for a zonal contact reservoir completion system that intends to simplify sandface completion installations in moderately low permeability, high drawdown environments. In this concept, downhole flow control is deployed inside the sand face as part of an intermediate completion run. For example, the lower completion string, which may be mechanically operated, is lowered in the wellbore and set, and all sand control treatment operations are performed with a service string moving inside the outer completion string from setting packers until the service string is pulled out of the wellbore. Subsequently, an intermediate completion string is lowered with a dip tube including flow control valves, and concentric seal assemblies positioned across the sand face. The valves are cycled in a screened position for production while precluding sand influx. The upper completion string is then lowered into the wellbore. In one or more embodiments of the present disclosure, the connection between the upper and lower completion string may be enabled via Schlumberger's Inductive Coupler, for example.

In this concept according to one or more embodiments of the present disclosure, there is no concentric annulus in the screens, in the completion, or in the service tool. As such, this completion design according to one or more embodiments of the present disclosure does not provide for a return flow path. The service string of the completion design according to one or more embodiments of the present disclosure is simple and open end, which makes the completion system more resistant to a high pumping rate. This completion design is solely a fracturing system in one or more embodiments of the present disclosure.

In one or more embodiments of the present disclosure, this completion system presents additional benefits in cased wellbores, as the completion components are built directly into the production liner and are actuated by use of a service tool. With the completion components built into the production liner, a larger completion ID is realized for a given wellbore size.

For example, the fluid communication flow paths provided by the completion design of FIGS. 7-9J may include an outer annulus between the open hole and screens (i.e., where the gravel is pumped); a service string annulus between the service string and the outer completion string that allows for setting all isolation or openhole packers and reversing out excess slurry inside the tubing; a service string ID that serves as a conduit to pump fluid from the workstring; and an upper-annulus above the production packer, between the casing and the tubing.

Figure 7:
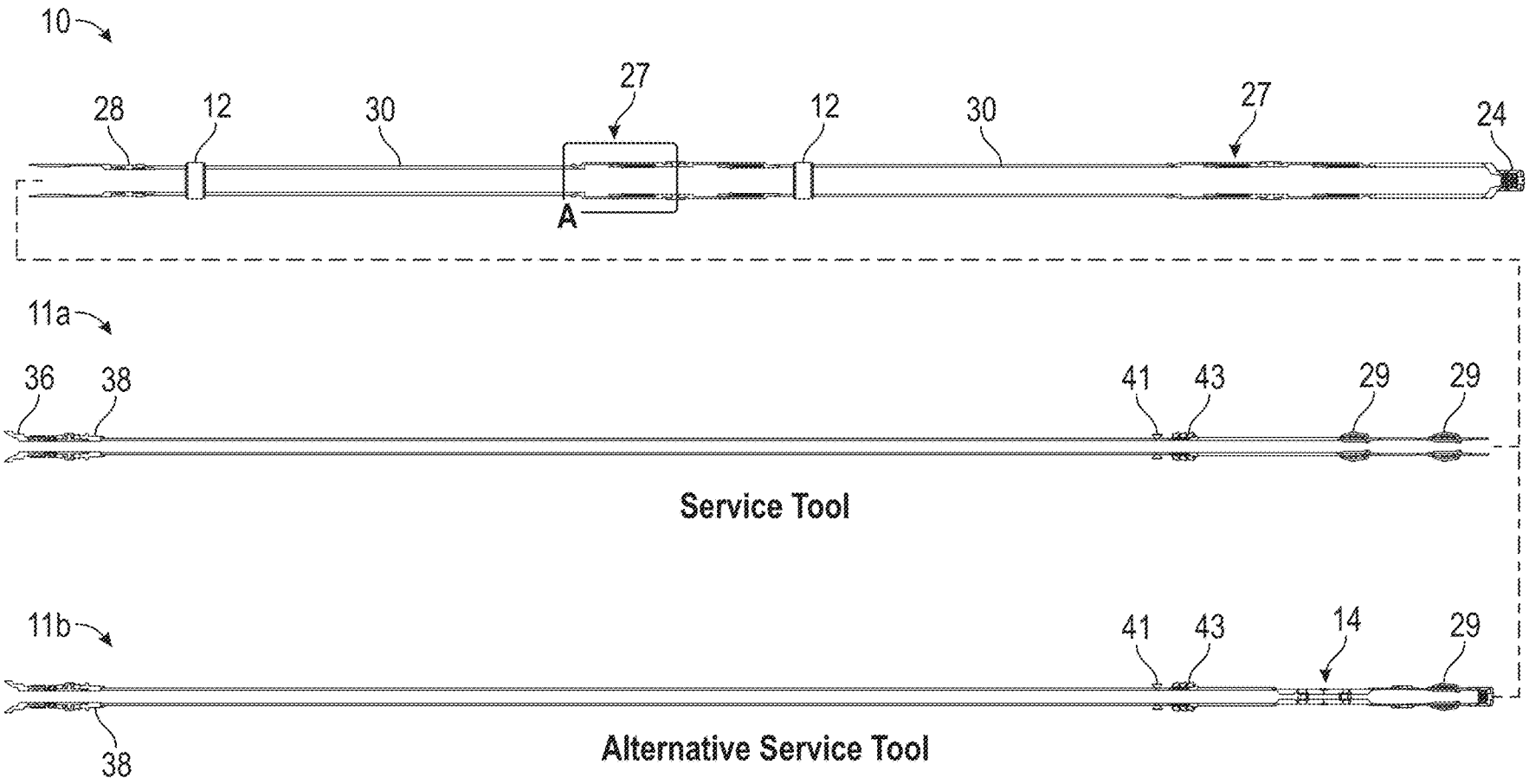
FIG. 7 shows a zonal contact completion system including an outer completion string and alternatives for an inner movable work string according to one or more embodiments of the present disclosure.

Referring specifically to FIG. 7, a system including an outer completion string 10 and an inner service string 11*a* or 11*b* according to one or more embodiments of the present disclosure is shown. In particular, FIG. 7 shows a layout of the outer completion string 10 and the inner service string 11 with their main components for a two zone completion. As shown in FIG. 7, the outer completion string 10 may include at least one isolation packer 12 or openhole packer between each well zone, separating two or more well zones. In one or more embodiments of the present disclosure, the at least one isolation packer 12 may include a melting isolating material, such as a metal or resin, for example. The well zones may include at least a bottom-most well zone in an uncased section of a wellbore and a top well zone in the uncased and cased sections of the wellbore. Of note, the outer completion string 10 according to one or more embodiments of the present disclosure may also operate in an entirely cased wellbore. Moreover, the well zones may also include any number of intermediate well zones between the bottom-most well zone and the top well zone according to one or more embodiments of the present disclosure.

Each of the bottom-most well zone and any intermediate well zone an openhole or isolation packer 12, at least one zonal contact valve 27, and blank pipe 30 to space out zonal contact valves 27 between well zones and within a given well zone. Moreover, in one or more embodiments of the present disclosure, the bottom-most well zone may include a washdown shoe 24, and the top well zone may include a latch profile 20 and a treatment packer 28 or control line set top packer that is hydraulically set in casing. In one or more embodiments of the present disclosure, the top well zone may also include an additional zonal contact valve 27 that is disposed downhole of the treatment packer 28. In one or more embodiments of the present disclosure, a zonal contact valve 27 is disposed uphole of the washdown shoe 24 in the bottom-most well zone.

In embodiments of the present disclosure where there is at least one intermediate well zone between the bottom-most well zone and the top well zone, the outer completion string 10 may include an additional zonal contact valve 27 and additional blank pipe 30 between the additional zonal contact valve 27 and an adjacent zonal contact valve 27 in the at least one intermediate well zone.

Still referring to FIG. 7, the inner service string 11*a*, 11*b* of the completion system according to one or more embodiments of the present disclosure is configured to movably connect within the outer completion string 10 of the completion system. As shown in FIGS. 9A-9I, the inner service string 11*a* is shown in operation with the outer completion string 10. While the sequence of operation of the inner service string 11*b* is not described with respect to this concept, the usage of inner service string 11*b* as an alternative service tool to inner service string 11*a* is contemplated and within the scope of the present disclosure. In one or more embodiments of the present disclosure, the alternative inner service string 11*b* includes a single circulating assembly 14 and a washdown shoe 25, as previously described in the aforementioned concept, for example. More detailed views of the inner service string 11*a*, 11*b* are provided in FIGS. 8C and 8D, for example.

As shown in FIG. 7, the inner service string 11*a*, 11*b* according to one or more embodiments of the present disclosure includes a workstring 36, which may work with or without telemetry in one or more embodiments, a set and release section 38, a hydraulic hold down module 41 set with ID to OD pressure differential, a plurality of cups 43 facing down (sealing only down to up) to prevent pressure build all the way to surface, and at least one shifter 29 or open and/or close collet to manipulate the zonal contact valves 27. In one or more embodiments of the present disclosure, the inner service string 11*a*, 11*b* may include a single shifter 29 that includes an open/close collet to manipulate a zonal contact valve 27. In other embodiments of the present disclosure, the inner service string 11*a*, 11*b*, may include two shifters 29 that are spaced apart, one shifter including an open collet and the other shifter including a close collet, for example.

Figure 8A:
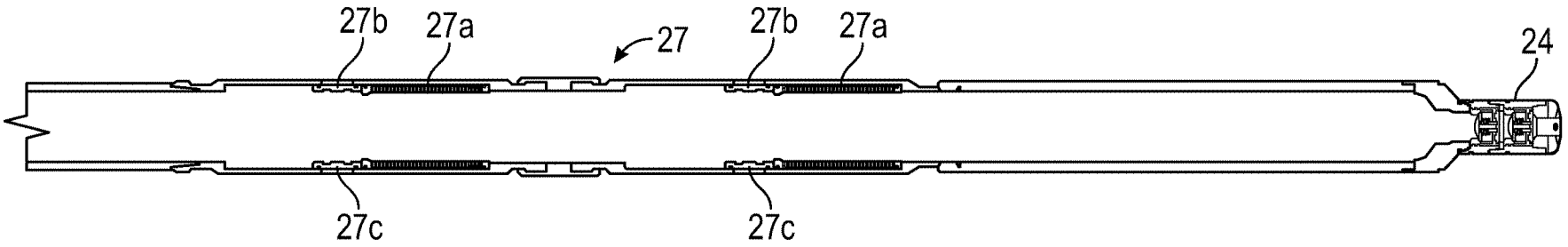
FIG. 8A shows further detail of the outer completion string for the zonal contact completion system according to one or more embodiments of the present disclosure.
Figure 8B:
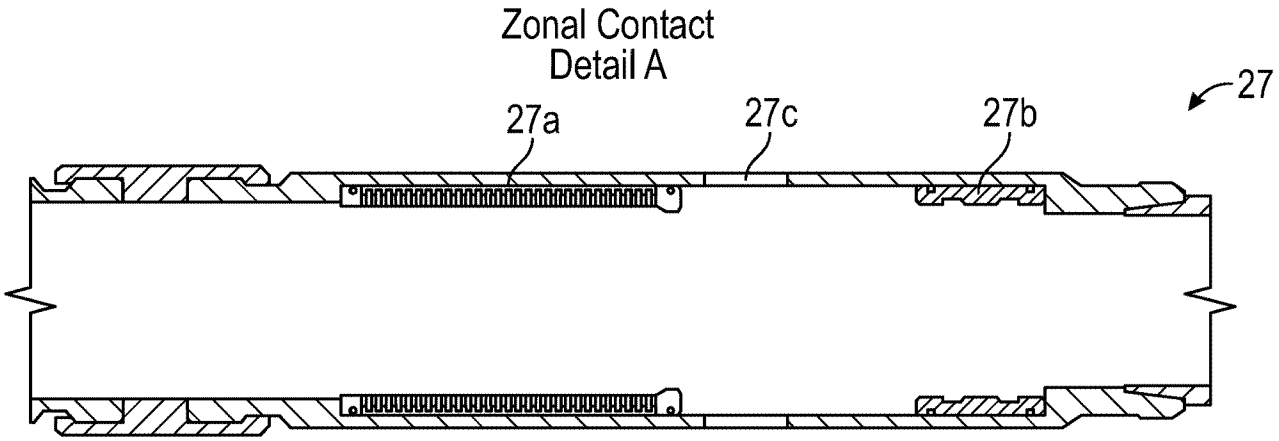
FIG. 8B shows further detail of the zonal contact valve of the outer completion string for the zonal contact completion system according to one or more embodiments of the present disclosure.
Figure 8C:
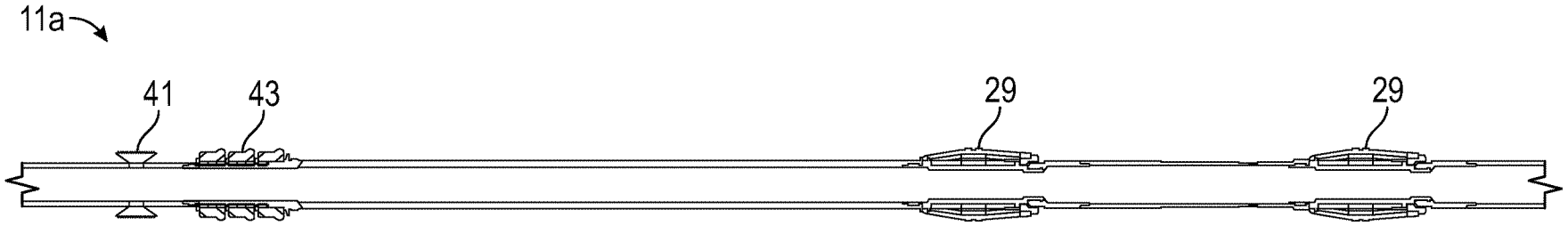
FIG. 8C shows further detail of an inner movable work string for the zonal contact completion system according to one or more embodiments of the present disclosure.
Figure 8D:
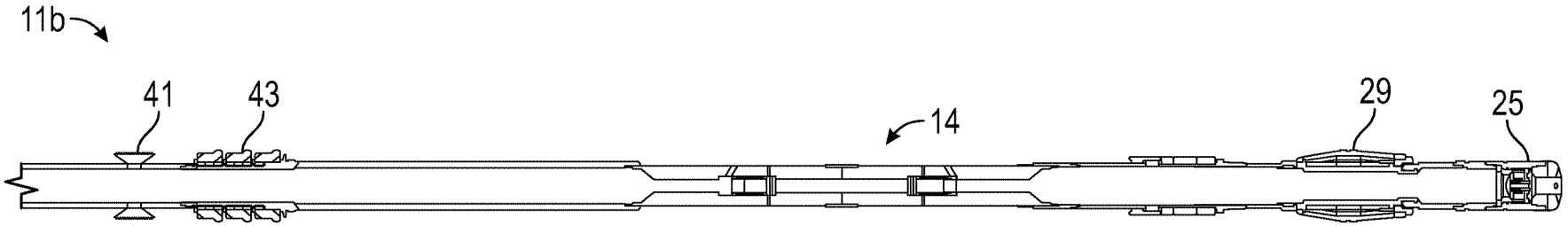
FIG. 8D shows further detail of an alternative inner movable work string for the zonal contact completion system according to one or more embodiments of the present disclosure.

Referring now to FIG. 8A, further detail of the outer completion string 10 for the zonal contact completion system according to one or more embodiments of the present disclosure is shown. As shown, in FIG. 8A and FIG. 8B, the zonal contact valve 27 includes at least one screen 27*a*, a sleeve 27*b*, and at least one port 27*c*. The zonal contact system according to one or more embodiments of the present disclosure features three position valves (i.e., open, close, and screen) placed adjacent to the producing zones of interest. In one or more embodiments of the present disclosure, multiple zonal contact valves 27 can be placed in each well zone, each zonal contact valve 27 featuring three operating positions: wellbore isolated (closed); wellbore open to formation (open); and wellbore production (screen). In one or more embodiments of the present disclosure, the zonal contact valve 27 opens up and closes down. In other embodiments of the present disclosure, the zonal contact valve 27 closes up and opens down. The screen position is also achieved via upward movement in one or more embodiments of the present disclosure. In one or more embodiments of the present disclosure, the sleeve 27*b* of the zonal contact valve 27 are mechanically shifted (thereby changing the valve configuration) by a shifting tool (i.e., the shifter 29) attached to the inner service string 11*a*, 11*b*. The shifter 29 include an open only and close only collet for the sleeve 27*b*. The screen 27*a* will be shifted using another collet that will be carried by an intermediate string in a separate trip, which is further described below.

Figure 9A:
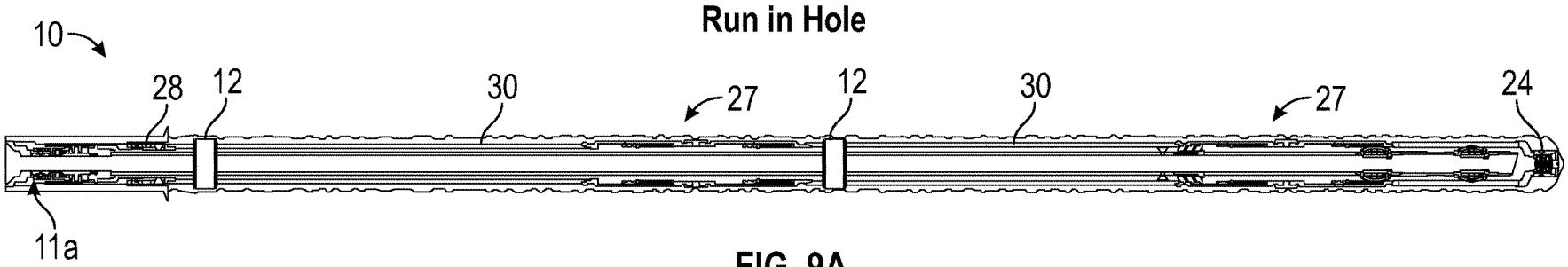
FIGS. 9A-9I show a method of completing a wellbore using a zonal contact completion system including an outer completion string, an inner movable work string, and an intermediate completion, according to one or more embodiments of the present disclosure.

Referring now to FIGS. 9A-9I, a method for completing a wellbore using an inner service string 11*a* movably arranged inside the outer completion string 10 according to one or more embodiments of the present disclosure is shown. After making up the lower completion and service tool assemblies at the rotary, the inner service string 11*a* connected within the outer completion string 10 may be deployed into the wellbore as shown in FIG. 9A in a method according to one or more embodiments of the present disclosure. In the run-in-hole position shown in FIG. 9A, all of the valves of the completion system, including the ports 27*c* of the zonal contact valve 27 are closed, as shown in FIG. 9J, for example. This allows fluid to be pumped from the workstring 36 through the ID of the inner service string 11*a*, down to and out of the washdown shoe 24 in the bottom-most well zone, and back to surface via the completion annulus. The open hole fluid can be displaced in that same position (i.e., tubing to annulus). The completion system is present as top filled in one or more embodiments of the present disclosure. An alternative filling methodology is possible in one or more embodiments of the present disclosure depending on the service tool release mechanism.

The method according to one or more embodiments of the present disclosure may further include setting the treatment packer 28 or top packer. The treatment packer 28 may be set hydraulically according to one or more embodiments of the present disclosure.

Figure 9B:
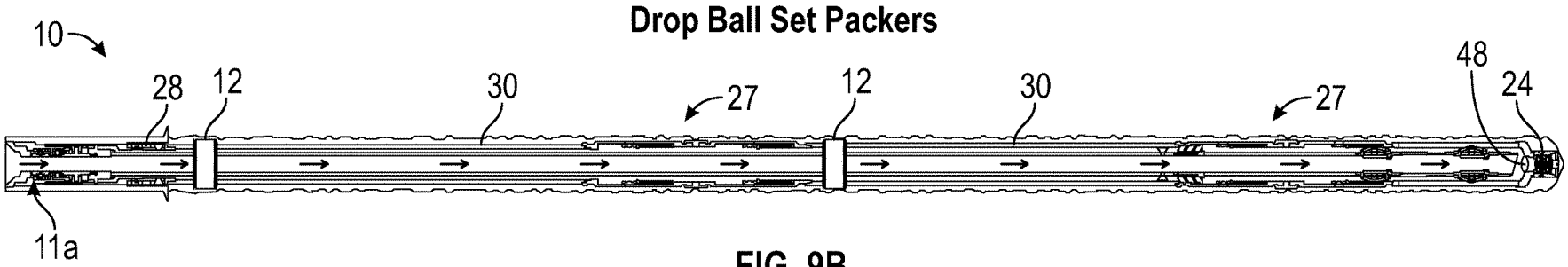

As shown in FIG. 9B, the method further includes dropping a washdown shoe 24 deactivation mechanism 48 to set the at least one isolation packer 12 in one or more embodiments of the present disclosure. In one or more embodiments of the present disclosure, the deactivation mechanism 48 may be a ball, a dart, a plug, or any mechanism that is capable of obstructing the washdown shoe 24. In this step, the at least one isolation packer 12 is hydraulically set. Pressure is delivered to the setting section via the workstring 36 up to the set and release section 38 bond seals, which sit in the top packer 28 PBR.

Figure 9C:
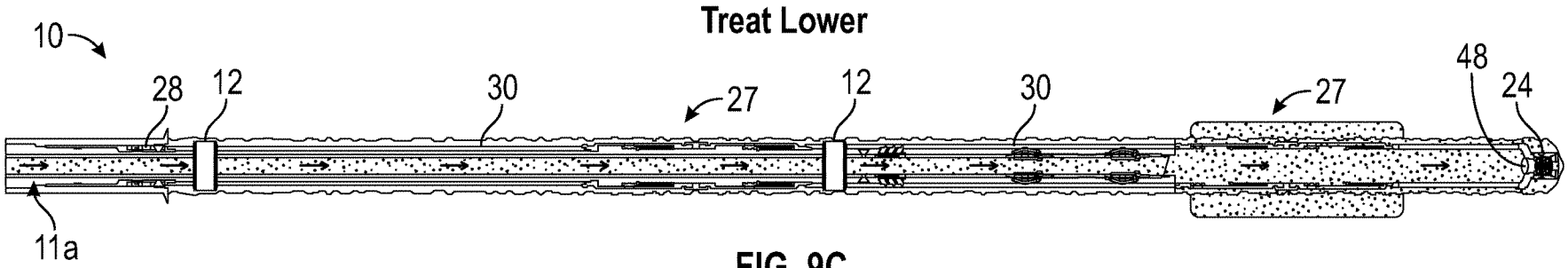

Thereafter, the zonal contact valve 27 in the bottom-most well zone may be opened by moving the inner service string 11*a* above the zonal contact valve 27, as shown in FIG. 9C. As further shown in FIG. 9C, the method further includes treating the bottom-most well zone. In one or more embodiments of the present disclosure, treating the bottom-most well zone includes performing a fracturing operation. In one or more embodiments of the present disclosure, the annular BOP may remain open during this step, and returns may be monitored (can be achieved with BOP closed and choke opened). During this step, treatment fluid is pumped down the inner service string 11*a* and out to the openhole through each zonal contact valve 27. Flow repartition between each valve depends on the reservoir characteristics.

Figure 9D:
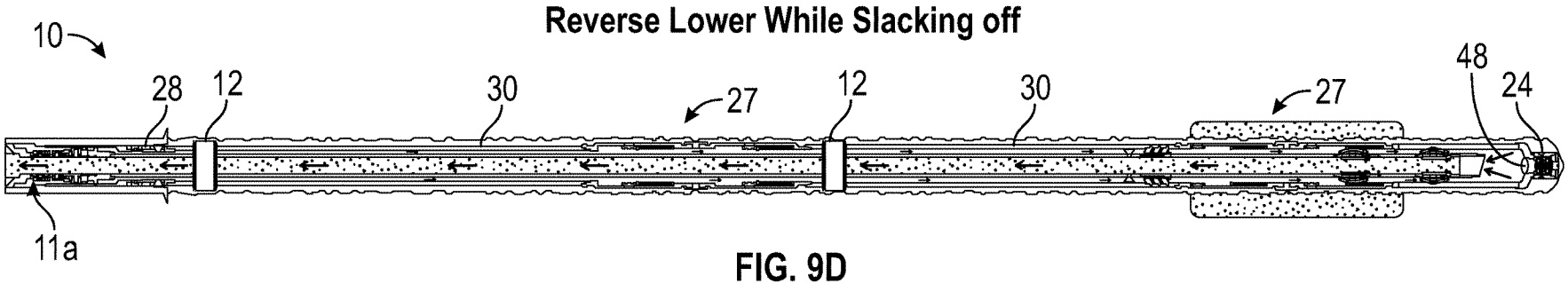
Figure 9E:
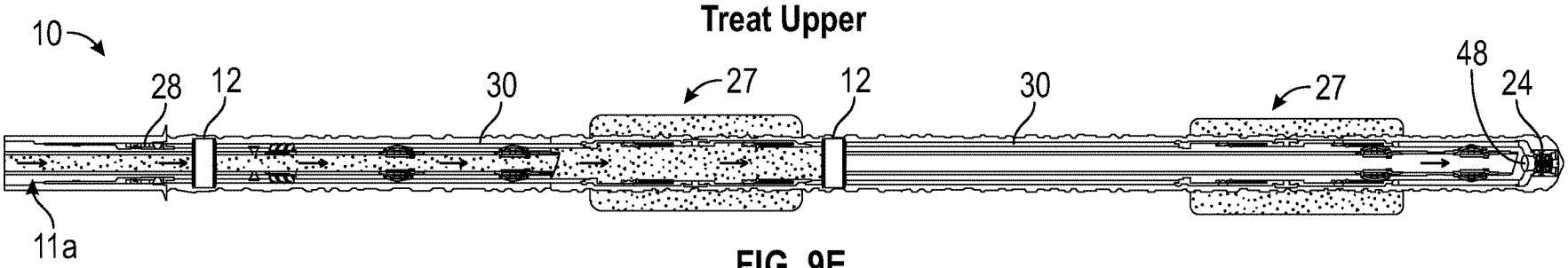
Figure 9F:
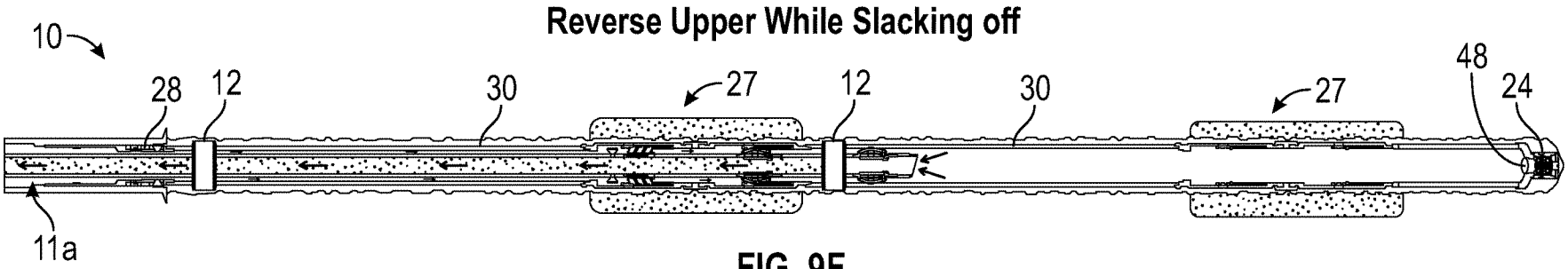

Thereafter, the zonal contact valve 27 in the bottom-most well zone may be closed by moving the inner service string 11*a* below the zonal contact valve 27. As shown in FIG. 9D, the method further includes reversing out the bottom-most well zone. At screen out, the completion ID is left with excess slurry. The inner service string 11*a* is lowered while pumping from the annulus, and excess slurry is recovered inside the tubing. In this process, each valve will be closed, as shown in FIG. 9J, for example. Reverse operation is completed once the inner service string 11*a* reaches below the bottom most zonal contact valve 27. While moving to the next well zone, each zonal contact valve 27 will be cycled from open to close.

Thereafter, the zonal contact valve 27 in the top well zone is opened by moving the inner service string 11*a* above or below the second zonal contact valve. Referring to FIGS. 9E and 9F, the method further includes treating the top well zone, closing the zonal contact valve 27 in the top well zone by moving the inner service string 11*a* above or below the zonal contact valve 27, and reversing out the top well zone. In one or more embodiments of the present disclosure, the operation continues with steps identical to those shown in FIGS. 9C and 9D with the port 27*c* of the zonal contact valve 27 in the top well zone open, as shown in FIG. 9J, for example. While treating the well zones from bottom to top is described here, the well zones may also be treated from top to bottom or in any other order without departing from the scope of the present disclosure.

Figure 9G:
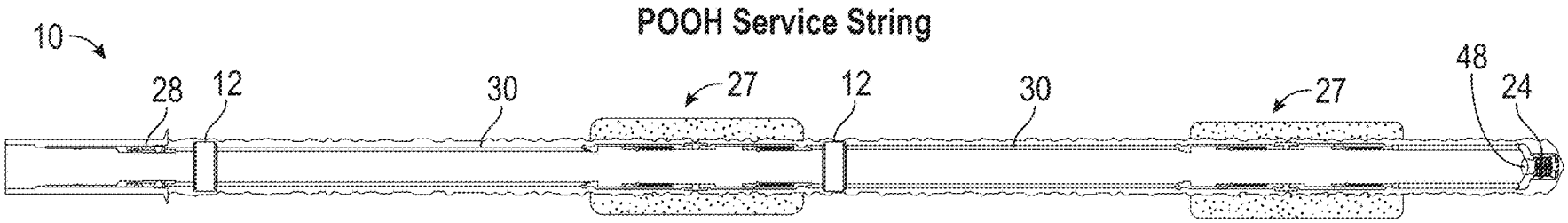

As shown in FIG. 9G, the method further includes, pulling out the inner service string 11*a* from the wellbore. Thereafter, a clean out trip may be performed in the method according to one or more embodiments of the present disclosure. In one or more embodiments of the present disclosure, each well zone is treated from bottom to top (or top to bottom in other embodiments of the present disclosure with additional risks), causing excess slurry to accumulate at the bottom of the outer completion string 10 during the operation. The clean out trip ensures circulation of all left over sand and debris prior to lowering the intermediate completion string 31.

Figure 9H:
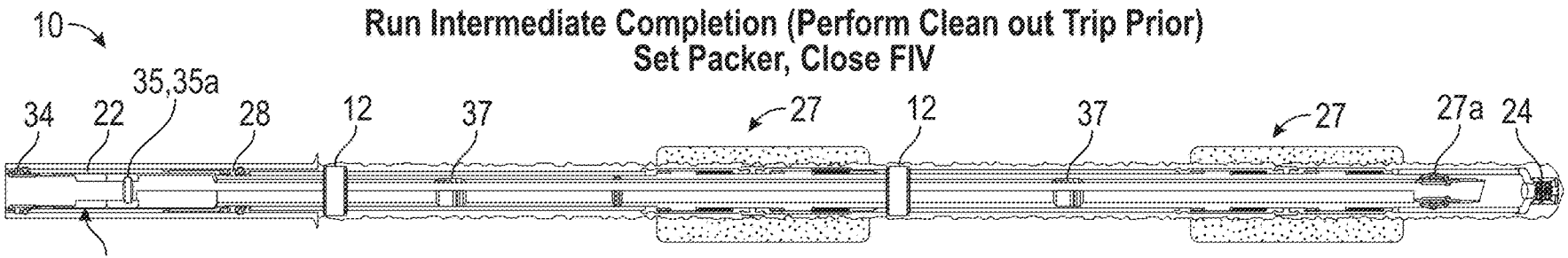

As shown in FIG. 9H, the method further includes running the intermediate completion string 31 in the wellbore. In one or more embodiments of the present disclosure, the intermediate completion string 31 may include an intermediate packer 34, a female inductive coupler 22, a formation isolation valve 35 with a trip saver 35*a*, a flow control valve 37 for each well zone of the plurality of well zones, and a zonal contact valve shifter 27*a*. In one or more embodiments of the present disclosure, the female inductive coupler 22, the formation isolation valve 35 with the trip saver 35*a*, each flow control valve 37, and the zonal contact valve shifter 27*a* are each downhole of the intermediate packer 34 on the intermediate completion string 31. While running the intermediate completion string 31 during this step of the method according to one or more embodiments of the present disclosure, each zonal contact valve 27 of the outer completion string 10 is moved to its screen position. Once at bottom, the intermediate packer 34 is set, and the service packer is retrieved, closing the formation isolation valve 35. With all system valves closed, as shown in FIG. 9J, for example, the wellbore is isolated.

Figure 9I:
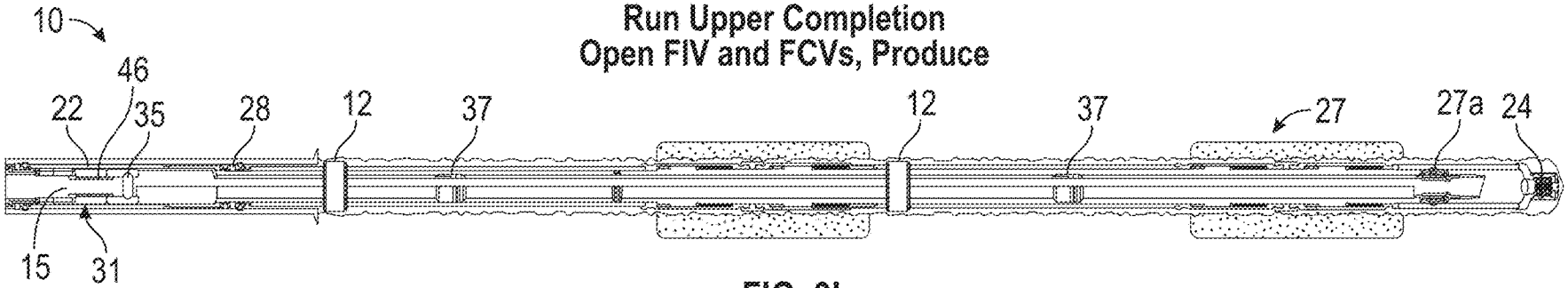
Figure 9J:
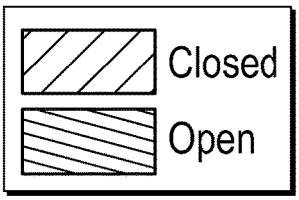
FIG. 9J shows a truth table of the system valves of the zonal contact completion system in view of the method shown in FIGS. 9A-9I, according to one or more embodiments of the present disclosure.

As shown in FIG. 9I, the method further includes running the upper completion 15 in the wellbore and connecting the male inductive coupler 46 of the upper completion 15 with the female inductive coupler 22 of the intermediate completion string. Thereafter, the formation isolation valve and each flow control valve on the intermediate completion string are opened, as shown in FIG. 9J for example, to facilitate production through the inner diameter of the system. In one or more embodiments of the present disclosure, each flow control valve may be operated via the electric line 32 and the inductive coupler, 22, 46. Advantageously, the method according to one or more embodiments of the present disclosure allows fracturing operations of multiple open hole or cased hole well zones with full zonal isolation.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system deployed in a wellbore extending through a plurality of well zones, the system comprising:

an outer completion string comprising:

at least one isolation packer positioned between well zones of the plurality of well zones, the plurality of well zones comprising:

a bottom-most well zone and a top well zone;

a washdown shoe disposed in the bottom-most well zone;

a first sand control filter and a first gravel pack extension, each disposed uphole of the washdown shoe in the bottom-most well zone, wherein in the top well zone, the outer completion string comprises a latch profile, a female inductive coupler, and a gravel pack packer, wherein, in the top well zone, the outer completion string further comprises a second sand control filter and a second gravel pack extension, each of the second sand control filter and the second gravel pack extension being disposed downhole of the gravel pack packer; and an inner service string configured to connect within the outer completion string, the inner service string comprising:

a workstring;

a set and release that connects to the latch profile of the outer completion string;

a power source;

a return valve configured to control fluid communication between an upper-annulus and an inner-annulus of the inner service string;

a circulating assembly for each well zone of the plurality of well zones;

an inner concentric string that is concentrically arranged within the workstring creating the inner-annulus between the workstring and the inner concentric string, wherein the inner-annulus is continuous from the circulating assembly for the bottom-most well zone to the return valve, wherein the circulating assembly of the inner service string comprises a reverse valve configured to control flow from the inner-annulus to the inner concentric string, a treat valve configured to control flow from the inner concentric string to an outer annulus outside the outer completion string to at least one of the plurality of well zones, and an isolation valve configured to control flow inside the inner concentric string or to isolate the inner service string below the isolation valve;

a port closure sleeve collet; and an upper completion comprising a male inductive coupler that is configured to connect with the female inductive coupler of the outer completion string to communicate power from the power source.

2. The system of claim 1, wherein the inner service string further comprises a concentric seal unit on each side of each circulating assembly.

3. The system of claim 1, wherein the inner service string further comprises a washpipe with a stinger, and the inner service string is stationary and does not move within the outer completion string.

4. The system of claim 1, wherein the workstring operates via telemetry.

5. The system of claim 1, wherein the plurality of well zones further comprises at least one intermediate well zone between the bottom-most well zone and the top well zone, the outer completion string further comprising:

a third sand control filter and a third gravel pack extension disposed in the at least one intermediate well zone.

6. The system of claim 1, wherein the return valve of the inner service string is remotely operated.

7. The system of claim 1, wherein each circulating assembly of the inner service string comprises a plurality of valves controlled via a hydraulic electric system.

8. The system of claim 1, wherein the at least one isolation packer of the outer completion string comprises a melting isolating material.

9. The system of claim 1, wherein at least one of an electric line or a fiber optic line runs through a length of the outer completion string.

10. The system of claim 1, further comprising a plurality of fluid communication flow paths, wherein the plurality of fluid communication flow paths includes:

the outer annulus between an open hole and screens;

a micro-annulus between screen wires and a non-perforated base pipe;

a service string annulus between the inner service string and the outer completion string configured to allow for setting a top-most isolation or openhole packer; and the upper-annulus above a production packer between a casing and a tubing.

11. The system of claim 1, wherein:

at least one of the first sand control filter or the second sand control filter comprises at least one pair of screen joints coupled at a screen joint connection, wherein each screen joint comprises a non-perforated base pipe, a screen disposed around the non-perforated base pipe, and a micro-annulus between the screen and the non-perforated base pipe, wherein the micro-annulus is continuous from screen joint to screen joint of the at least one pair of screen joints, wherein a downhole flow control valve is positioned next to or within one of the screen joints.

12. A method of completing a wellbore comprising:

deploying the inner service string connected within the outer completion string of the system of claim 5 in one trip into the wellbore;

setting the gravel pack packer;

pumping displacement fluid through the system in a tubing-to-annulus direction or in an annulus-to-tubing direction;

setting the at least one isolation packer;

treating the bottom-most well zone;

reversing out the bottom-most well zone;
treating the top well zone;
reversing out the top well zone;
pulling out the inner service string from the wellbore;
running the upper completion in the wellbore and connecting the male inductive coupler of the upper completion with the female inductive coupler of the outer completion string;
setting a production packer in the top well zone of the outer completion string; and
opening the downhole flow control valve of the first and second sand control filters to facilitate production through an inner diameter of the system.

* * * * *